US008876585B1

(12) United States Patent
Ghaly

(10) Patent No.: US 8,876,585 B1
(45) Date of Patent: Nov. 4, 2014

(54) METHOD AND APPARATUS FOR ELECTRONIC PUZZLE DEVICE

(76) Inventor: Nabil N. Ghaly, South Huntington, NY (US)

( * ) Notice: Subject to any disclaimer, the term of this patent is extended or adjusted under 35 U.S.C. 154(b) by 1473 days.

(21) Appl. No.: 11/974,237

(22) Filed: Oct. 12, 2007

Related U.S. Application Data

(60) Provisional application No. 60/852,858, filed on Oct. 20, 2006.

(51) Int. Cl.
*A63F 9/24* (2006.01)

(52) U.S. Cl.
USPC ..... 463/9; 463/23

(58) Field of Classification Search
USPC ..... 463/9, 14, 15, 23, 37; 273/153 R, 460
See application file for complete search history.

(56) References Cited

U.S. PATENT DOCUMENTS 4,019,745 A * 4/1977 Mustelier ..... 463/14
4,240,638 A * 12/1980 Morrison et al. ..... 463/15
4,279,421 A * 7/1981 Tepoorten et al. ..... 273/237
4,398,720 A * 8/1983 Jones et al. ..... 463/14
4,809,979 A * 3/1989 Skowronski et al. ..... 463/9
4,957,291 A * 9/1990 Miffitt et al. ..... 463/9
5,215,311 A * 6/1993 Schuller ..... 463/9
5,278,542 A * 1/1994 Smith et al. ..... 345/690
5,286,037 A * 2/1994 Ghaly ..... 463/9
5,417,425 A * 5/1995 Blumberg et al. ..... 273/153 R
5,564,702 A * 10/1996 Meffert ..... 273/153 R
5,573,245 A * 11/1996 Weiner et al. ..... 273/153 R
5,603,500 A * 2/1997 Olti et al. ..... 273/153 R
5,855,513 A * 1/1999 Lam ..... 463/9
5,992,849 A * 11/1999 Olti et al. ..... 273/153 R
6,398,641 B1 * 6/2002 Yamagami et al. ..... 463/9
7,059,964 B1 * 6/2006 Harpaz ..... 463/9
7,291,065 B2 * 11/2007 Lee ..... 463/9
7,371,177 B2 * 5/2008 Ellis et al. ..... 463/42
7,618,313 B2 * 11/2009 Ghaly ..... 463/9

* cited by examiner

*Primary Examiner* — Jay Trent Liddle

(57) ABSTRACT

An electronic puzzle, method and apparatus, is disclosed which includes a playfield that is subdivided into a plurality playing positions. Each playing position includes a switch, and an indicator that includes at least a first indicating element and a second indicating element, and each of said indicating elements has a plurality of indicating states to provide a plurality of visual indications. Further each playing position has a geometric pattern that is activated by the associated switch. The object of the game is for the player to manipulate the switches in order to transform an initial pattern of visual indications to a desired pattern of visual indications. Upon the activation of a switch, the first indicating element of at least one playing position in the associated geometric pattern changes its indicating state, and the second indicating element of at least one different playing position in said associated geometric pattern changes its indicating state. The device employs a microprocessor to control the progress of the game, monitor the activation of the switches, updates the indicating states of affected indicating elements in the associated geometric pattern, and generates new visual indications based on the updated indicating states. The microprocessor also controls the generation of audio/visual effects to enhance the enjoyment of play. Further, the device employs means to generate a plurality of puzzles, and games, and provisions to vary the level of difficulty of play.

28 Claims, 19 Drawing Sheets

6x6 LCD DEVICE

5x5 LED DEVICE

6x6 LCD DEVICE

EXAMPLES OF GEOMETRIC PATTERNS

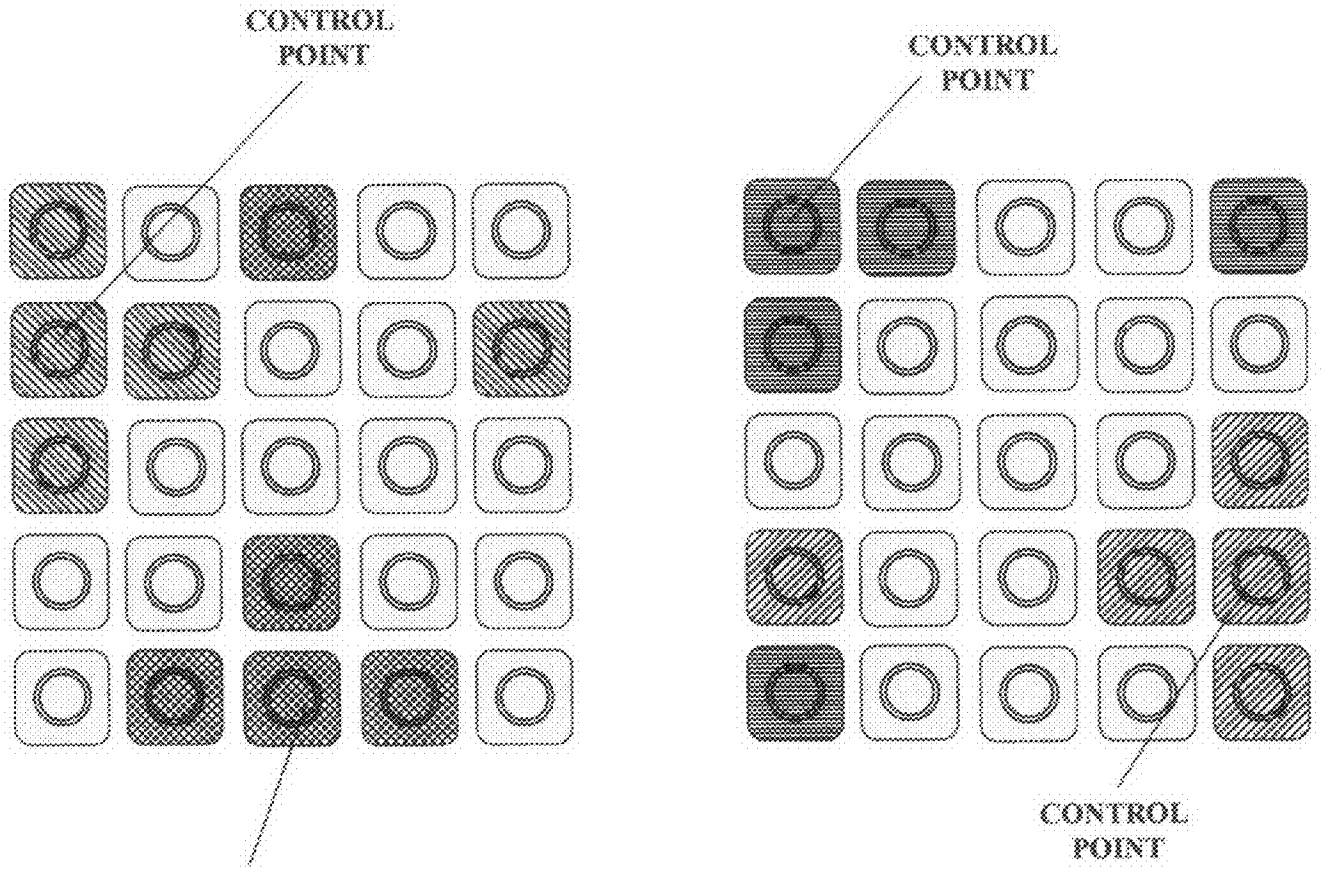
Figure – 6 –

| INITIAL INDICATION | INDICATION AFTER ACTIVATION OF CONTROL POINT |
|---|---|
| DARK/DARK | RED/DARK |
| RED/DARK | DARK/DARK |
| DARK/GREEN | RED/GREEN |
| RED/GREEN | DARK/GREEN |

TOP & LEFT INDICATORS

| INITIAL INDICATION | INDICATION AFTER ACTIVATION OF CONTROL POINT |
|---|---|
| DARK/DARK | RED/GREEN |
| RED/DARK | DARK/GREEN |
| DARK/GREEN | DARK/DARK |
| RED/GREEN | RED/DARK |

RIGHT& BOTTOM INDICATORS

| INITIAL INDICATION | INDICATION AFTER ACTIVATION OF CONTROL POINT |
|---|---|
| DARK/DARK | RED/GREEN |
| RED/DARK | DARK/GREEN |
| DARK/GREEN | RED/DARK |
| RED/GREEN | DARK/DARK |

CENTER INDICATOR

Figure – 7 -

| INITIAL INDICATION | INDICATION AFTER ACTIVATION OF CONTROL POINT |
|---|---|
| DARK | RED |
| RED | DARK |
| GREEN | YELLOW |
| YELLOW | GREEN |

TOP LEFT & BOTTOM LEFT INDICATORS

| INITIAL INDICATION | INDICATION AFTER ACTIVATION OF CONTROL POINT |
|---|---|
| DARK | GREEN |
| RED | YELLOW |
| GREEN | DARK |
| YELLOW | RED |

TOP RIGHT& BOTTOM RIGHT INDICATORS

| INITIAL INDICATION | INDICATION AFTER ACTIVATION OF CONTROL POINT |
|---|---|
| DARK | YELLOW |
| RED | GREEN |
| GREEN | RED |
| YELLOW | DARK |

CENTER INDICATOR

Figure – 10 -

CUBE LED DEVICE

| INITIAL INDICATION | INDICATION AFTER ACTIVATION OF CONTROL POINT |
|---|---|
| DARK/DARK | DARK/YELLOW |
| DARK/YELLOW | DARK/DARK |
| BLUE/DARK | BLUE/YELLOW |
| BLUE/YELLOW | BLUE/DARK |

"A" INDICATORS

| INITIAL INDICATION | INDICATION AFTER ACTIVATION OF CONTROL POINT |
|---|---|
| DARK/DARK | BLUE/DARK |
| RED/YELLOW | BLUE/YELLOW |
| BLUE/DARK | DARK/DARK |
| BLUE/YELLOW | DARK/YELLOW |

"B" INDICATORS

| INITIAL INDICATION | INDICATION AFTER ACTIVATION OF CONTROL POINT |
|---|---|
| DARK/DARK | BLUE/YELLOW |
| DARK/YELLOW | BLUE/DARK |
| BLUE/DARK | DARK/YELLOW |
| BLUE/YELLOW | DARK/DARK |

"C" INDICATOR

Figure – 15 -

METHOD AND APPARATUS FOR ELECTRONIC PUZZLE DEVICE

This utility application benefits from provisional application of U.S. Ser. No. 60/852,858 filed on Oct. 20, 2006.

BACKGROUND OF THE INVENTION

1. Field of the Invention

This invention relates generally to electronic hand held games and in particular to an electronic puzzle, wherein the field of play consists of a plurality of playing positions that are mapped on the surface of the puzzle device, and wherein each playing position includes an indicator. Each indicator includes at least two independent indicating elements such that when the first element is activated the indicator indicates a first visual indication, when the second element is activated, the indicator indicates a second visual indication, and when both elements are activated, the indicator indicates a third visual indication. A fourth visual indication is produced when both elements are not activated. The field of play could be configured as a two-dimensional array of indicators, or could be mapped on the surface of a three-dimensional housing, such as a cube, a sphere, an egg, a cone shaped device, or the like. A visual indication could be in the form of an image, or an illuminated or reflected color. The puzzle device, also, includes a plurality of control points to enable a player to activate the indicating elements of the various indicators. The control points could include switches located on the field of play. These switches could be located at each playing position, or could be in the form of a computer mouse type control mechanism that enables a player to select and activate any playing position on the playfield.

It is possible, by manipulating the control points in a particular manner or pattern, and by observing the resulting effect on the indicators, to determine a pattern of control activation's which transforms an initial display on the playfield to a desired display.

2. Description of the Related Art

During the last twelve years, a number of patents have been issued related to electronic handheld puzzles that employ a field of play divided into a plurality of playing positions, and wherein each playing position includes a switch and an indicator. These patents include U.S. Pat. Nos. 5,286,037; 5,417,425; 5,564,702; 5,573,245, and 5,603,500. However, with the exception of U.S. Pat. No. 5,286,037, the remaining patents relate to indicators that are limited to only two indicating states. Further, the devices described in these patents have the common characteristic of employing a single algorithm that defines the relationship between control switches and indicators.

The present invention provides a more challenging game play than could be provided by the prior art by using at least two different algorithms to control the two independent indicating elements of the indicators. Since each independent element produces a different visual indication, it is feasible to construct puzzle devices that employ multiple colors or images.

OBJECT OF THE INVENTION

One object of the current invention is to provide a versatile electronic puzzle that can be implemented using a two-dimensional array of indicators, or a plurality of indicators mapped on the surface of a three-dimensional shape.

Another object of the invention is to provide an electronic puzzle device that operates with many color configurations or images ranging from a minimum of three colors or images to a maximum number of colors or images determined by the number of independent indicating elements used.

It is another object of the present invention to provide an electronic puzzle device with a game objective to reach a final game state in which groups of indicators are displaying different visual indications.

It is a further object of this invention to provide an electronic puzzle device utilizing a plurality of switches to manipulate the states of indicating elements, and wherein a player must determine an exact combination of switch's activations, which results in a first predetermined group of indicators indicating a first visual indication, a second predetermined group of indicators indicating a second visual indication, a third predetermined group of indicators indicating a third visual indication, etc.

It is still an object of the present invention to provide an electronic puzzle device utilizing a plurality of indicators each of which may include two or more indicating elements, and wherein each produces a different visual indication.

It is also an object of this invention to provide an electronic puzzle device utilizing a plurality of indicators each of which includes a plurality of indicating elements, and wherein each indicating element produces a plurality of graphic symbols or images.

It is yet another object of this invention to provide an electronic puzzle device that utilizes a microprocessor to generate a plurality of games.

It is still another object of the present invention to provide an electronic puzzle device, which employs one or more liquid crystal displays whereon a plurality of images is indicated.

It is also another object of the present invention to provide an electronic puzzle device having a three-dimensional housing such as a sphere, a cube, a pyramid, or the like, whereon a plurality of controls and indicators are located, and wherein the objective of the game is to display a plurality of different images on predetermined groups of indicators.

It is also an object of this invention to provide a handheld electronic puzzle device, which employs light emitting diode displays, i.e. illuminated colors and/or images, or liquid crystal displays to provide a plurality of visual indications.

It is a further object of this invention to provide a handheld electronic puzzle device with puzzles and games in various levels of difficulty.

It is still an object of this invention to provide an electronic puzzle device that can be played as a computer game, a video game, or as a game that can be loaded to a handheld game device, such as Game Boy, or to a handheld consumer electronic device such as a Palm Pilot, a cell phone, a Blackberry, etc.

It is also an object of this invention to provide an electronic puzzle device, which incorporates audible and visual effect to heighten the enjoyment of play.

SUMMARY OF THE INVENTION

Because of the versatility of the general concept described herein, and the very large number of embodiments that could be used to implement this concept, the preferred embodiments are only examples selected out of numerous possible embodiments that could be built using the teaching of the specification herein. These embodiments may vary in size, shape, number of elements per indicator, or number of colors or images. However, they are all based on the principle of employing at least two different algorithms to activate independent indicating elements at indicators associated with a geometric pattern. At least two algorithms are simultaneously activated by a single control point associated with the geometric pattern. Because each playing position has a geometric pattern that affects a plurality of indicators, it follows that each playing position includes a control point. A control point could be implemented using an individual momentary switch, or could be achieved by a computer mouse type control mechanism that includes a cursor control to select a playing position, and a momentary switch to activate the selected playing position.

Since the primary control function to activate the indicating elements at indicators is based on associating a control point with any pre-defined plurality of indicators, the objects of the invention are achieved by a playfield that includes a two-dimensional array of indicators, or by a playfield wherein the indicators are mapped on the surface of a three-dimensional shape such as a cube, a sphere, a pyramid, an egg shaped device, or the like. The preferred embodiment provides examples that include two-dimensional arrays of indicators having playfields that employ 5×5; 4×4 and 6×6 indicators, as well as three-dimensional embodiments. The three-dimensional examples include a cube having nine (9) indicators on each of its six sides, and a sphere having twelve (12) indicators mapped on its surface. The preferred embodiments also provide a number of examples of a geometric pattern that defines a cause/effect relationship between a control point and a group of indicators. These examples include a cross (+), an X, a cross & an X superimposed on each other, and a circle.

In its simplest form each indicator includes two indicating elements, and each indicating element has two indicating states. A basic indicating element could consist of a colored bulb, or a light emitting diode (LED). When such element is activated or energized, i.e., "ON," an illuminated color is emitted from the indicator, and when the element is de-energized, i.e., "OFF," a second color is reflected from the surface of the indicator. Because each indicator includes two elements, it can provide four different visual indications. The first visual indication is produced when both indicating elements are de-energized. In such a case the visual indication consists of the reflected color from the surface of the indicator. The second visual indication is produced when the first element is energized, and the second element is de-energized. In such a case the visual indication is a first emitted color produced by the first element. Similarly, the third visual indication is produced when the first element is de-energized, and the second element is energized. In such a case the visual indication is a second emitted color produced by the second element. The fourth visual indication is produced when both elements are energized. In such a case the visual indication consists of two emitted colors of light. It is a matter of design choice to merge the two emitted colors so that a third emitted color is produced, or to keep the two emitted colors separated so that both emitted colors are visible. For example, if the first emitted color is red, and the second emitted color is green, by merging the two colors, a third emitted color, yellow, is generated. Alternatively, the two lighted visual indications could be separated, and the visual indications will consist of DARK-DARK, GREEN-DARK, DARK-RED, and GREEN-RED.

The general operation of the geometric pattern is such that when a control point is activated at least one indicator in the geometric pattern has its first indicating element reversed, i.e., switches from "ON" to "OFF" or from "OFF" to "ON." Also, at least one other indicator in the geometric pattern has its second indicating element reversed, i.e., switches from "ON" to "OFF" or from "OFF" to "ON." For example, a preferred embodiment that employs the cross geometric pattern has five indicators, and a control point associated with its center indicator. When the control point is activated, the first indicating elements at the top and left indicators are reversed, and the second indicating elements at the right and bottom indicators are reversed. Further, both the first and second indicating elements at the center indicator are reversed. Accordingly, in this example of a cross geometric pattern there are three different algorithms, or rules. The first algorithm applies to the top and left indicators of a "+" geometric pattern, and affects only the first indicating element. The second algorithm applies to the right and bottom indicators of a "+" geometric pattern, and affects only the second indicating element, and the third algorithm applies only to the center indicator, and affects both indicating elements.

It should be noted that the indicators could also be implemented using a graphic display device such as a liquid crystal display (LCD) screen, a cathode ray tube (CRT) screen, a digital light processor (DLP) screen, or a screen that employs plasma technology. In such a case the screen is divided into an array of playing positions, and each playing position includes an area of the screen that represents an indicator, wherein a plurality of images is indicated. The images are configured into a plurality of groups such that each group is activated independently from the other groups at the indicators. For example, if two groups of images are employed then each indicator could indicate a "BLANK" display, a first image from the first group, a second image from the second group, or said first and second images superimposed on each other.

The images could be in the form of geometric shapes, or jigsaw pieces wherein each piece is split into a plurality of segments, or any other form. For example, if two groups of geometric shapes are used then the first group could consist of red circles, and the second group could consist of green squares. Each indicator could then display a blank indication, a red circle, a green square, or a red circle inside a green square.

Alternatively, when jigsaw pieces are used, each indicator is assigned a piece of the jigsaw puzzle based on its location. For example, if the jigsaw puzzle represents a picture or an image, then each piece of the jigsaw puzzle is associated with an indicator (playing position) on the playfield. In turn, each piece is divided into two segments such that the first segment belongs to a first group of images, and the second segment belongs to a second group of images. Each indicator could then display a blank indication, the first segment of a jigsaw piece, the second segment of a jigsaw piece, or the complete jigsaw piece assigned to the indicator.

Another alternative embodiment could employ two groups of images such that the first group includes a plurality of characters, and the second group includes a plurality of accessories. Each playing position is then assigned a specific character/accessory combination. One object of the puzzle would then be to find all the characters and their associated accessories.

Similar to the embodiment that employs illuminated colored lights, an embodiment that uses an LCD screen, or the like, also, implements a geometric pattern that defines a relationship between a control point and a plurality of indicators. For example, if an "X" geometric pattern is used then there are three different algorithms, or rules. The first algorithm applies to the top-left and bottom-left indicators, and affects only the first indicating element (first group of images). The second algorithm applies to the top-right and bottom-right indicators, and affects only the second indicating element (second group of images), and the third algorithm applies only to the center indicator, and affects both indicating elements (first and second groups of images).

It should also be noted that it is a matter of a design choice to vary the number of indicating elements used per indicator, as well as the number of algorithms, or rules employed by the device. As would be appreciated by a person skilled in the art, more challenging puzzles could be developed by increasing the number of indicating elements and/or algorithms employed by an embodiment.

The puzzle devices described herein provide a plurality of puzzles, and each puzzle includes a plurality of games. A puzzle is defined by an objective. For example, when illuminated colors are used, puzzle #1 is defined by the objective of having all indicators dark, i.e., reflecting the external color of the indicator. Puzzle #2 is defined by the objective of having all indicators emitting color #1. Similarly, puzzle #3 is defined by the objective of having all indicators emitting color #2. Puzzle #4 is defined by the objective of having all indicators emitting both color #1 and color #2. Additional objectives could also be provided, wherein the objective of a puzzle could be a first group of indicators producing a first visual indication, a second group of indicators producing a second visual indication, a third group of indicators producing a third visual indication, etc.

Further, each game in a puzzle is defined by an initial game state that presents an initial display of colors or images to a player, and a game objective in the form of the final desired display of colors or images. The initial display is produced by establishing an initial indicating state for each indicating element at each playing position. The initial display could simply be generated from the objective of the puzzle by activating a plurality of control points, and recording the resulting indicating states for all indicating elements at all playing positions. The resulting display then becomes the initial display for a particular game. Such initial display data is then stored as game data in the data field of the control program, which controls the operation of the device. The player can select from a plurality of games stored in the memory of the device.

As would be appreciated by persons skilled in the art, the design parameters could be manipulated to provide puzzles in various levels of difficulty. For example, an increase in the number of indicating elements results in more difficult puzzles. Also, the number of steps required to solve a game in a puzzle determines how easy or difficult a game is.

When an LCD display is used, it would be desirable to employ an input control mechanism consisting of a mouse control with a momentary switch. In such case, the mouse control is used to place a cursor at a playing position, and the switch is used to activate the selected playing position. Alternatively, a game designer may elect to employ touch screen controls.

To heighten the enjoyment of play, a variety of audio and/or visual indications are provided. Such indications could include tones generated in response to switch activations, flashing indicators, and/or the generation of tunes upon the successful completion of a game or an objective of a puzzle. Statistics could also be kept about the performance of players in solving games or puzzles. Such statistics could include the number of steps used by a player to solve the puzzle, and/or the time used to reach a solution. A game could also be timed to challenge a player to solve the game within a predefined period of time.

Each of the preferred embodiment devices is implemented using a microprocessor to control the various aspects of game play. The various parameters and attributes of a puzzle or a game are stored in the read only memory of the device. Alternatively such parameters could be provided in a removable flash memory to enable future additions of puzzles and games. The microprocessor is programmed to monitor the activation of the control switches that control indicating elements at indicators included in an associated geometric pattern, and calculate new displays for the indicators. The microprocessor is also programmed to determine if a solution is reached for the game in play, and to generate the appropriate audio/visual effects to reward a player for solving a game.

The indicators of the preferred embodiments could be implemented using LED displays or LCD screens. When LED displays are used, different colors could be provided using one discrete LED for each color, or by employing multi-color LEDs that provide two or more colors in addition to being unilluminated. For the purposes of this invention "dark," when used as a design choice to represent one of the visual indications, is considered a color represented by the color reflected from the surface of the indicators. Therefore, a two-color device could be implemented using the "on" and "off" visual indications resulting from a single color LED. It should be noted that the use of LED displays is only for the purpose of describing preferred embodiments, and is not intended to limit the invention herein. As would be understood by a person of ordinary skills in the art, any light emitting means, such as incandescent or fluorescent bulbs, could be used to provide visual indications.

When LCD screens are used, such screens could be of the monochromic type or the color type. When monochromic screens are used, the plurality of images could be provided by different images. When colored screens are used, the plurality of images could be provided by different images or symbols, or by the same image or symbol depicted in different colors. For the purposes of this invention a blank display could be used to represent an indicating state. Therefore, a two-image puzzle could be implemented using a single image and a blank display.

The puzzle device could also be provided as a computer game that is played on a desktop, or laptop computer, or could be designed as a game provided on a CD, DVD or special cartridge for electronic games such as Game Cube, PS2, X-Box, Game Boy, or the like. The Puzzle device could also be provided as a game on a consumer electronic device such as a palm pilot, a Blackberry, a cell phone, or the like.

BRIEF DESCRIPTION OF THE DRAWINGS

These and other more detailed and specific objectives will be disclosed in the course of the following description taken in conjunction with the accompanying drawings wherein:

FIG. 6 indicates examples of the "+" geometric pattern when the associated control point is located at the perimeter of a two dimensional playfield.

FIG. 7 provides three (3) tables that summarize the rules for the "+" geometric pattern used for the preferred embodiment shown in FIG. 1.

FIG. 10 provides three (3) tables that summarize the rules for the "x" geometric pattern used for the preferred embodiment shown in FIG. 2.

FIG. 15 provides three (3) tables that summarize the rules for the circular geometric pattern shown in FIG. 14.

DESCRIPTION OF PREFERRED EMBODIMENTS

Figure 1:
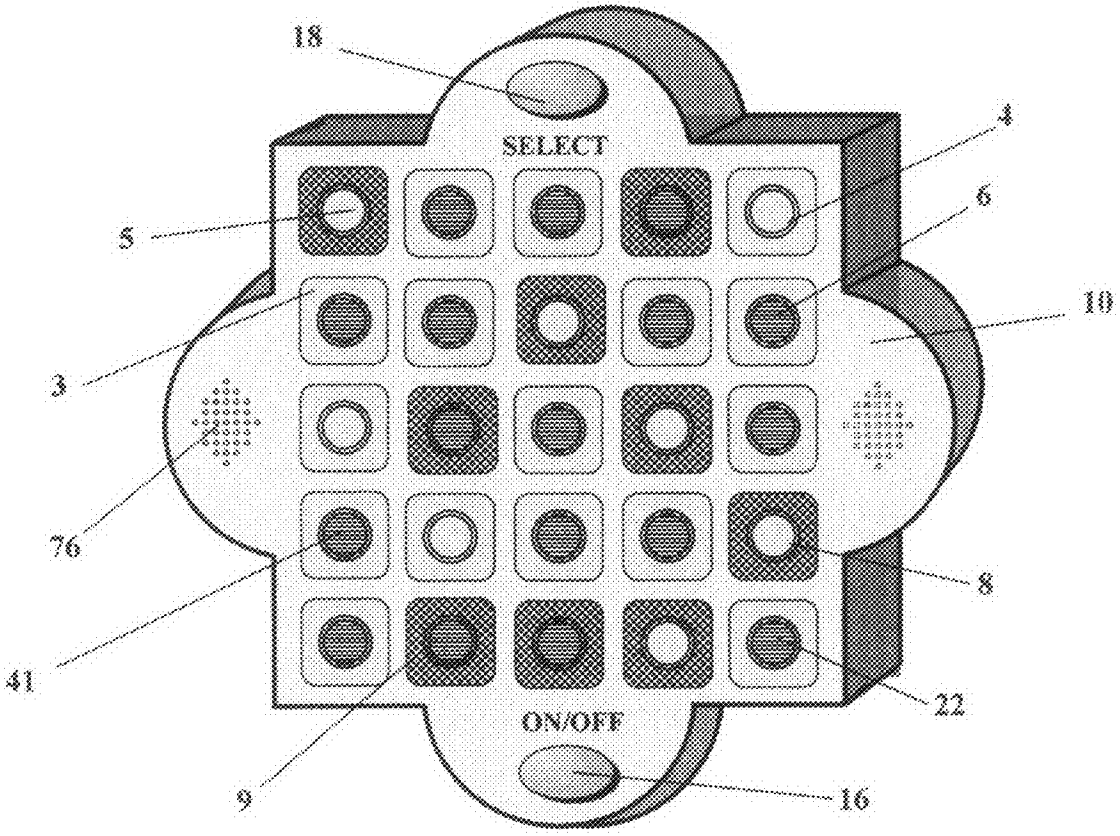
FIG. 1 is a perspective view of a preferred embodiment of a puzzle device with a 5×5 array of playing positions, and wherein each playing position includes two segregated LED indicators.
Figure 2:
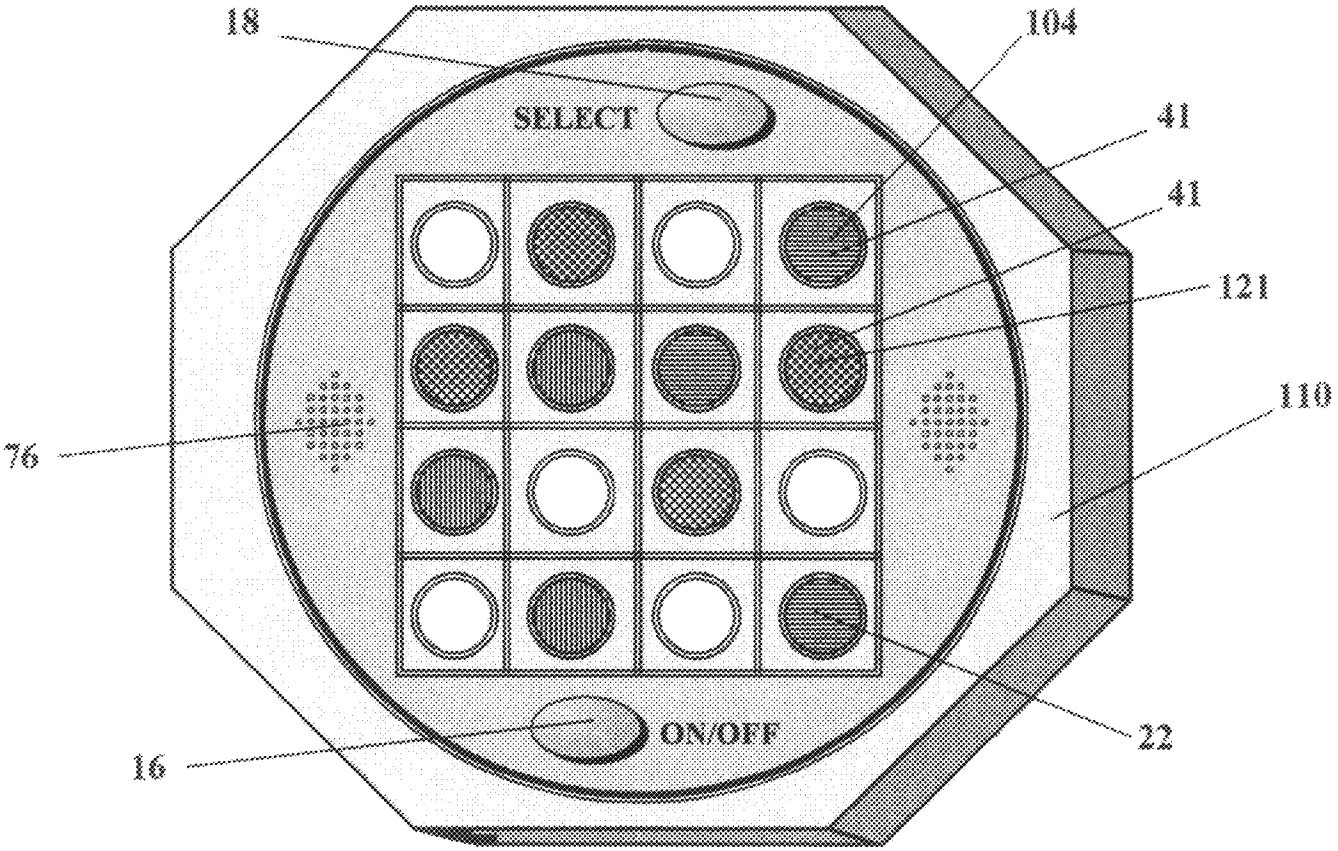
FIG. 2 is a perspective view of a preferred embodiment of a puzzle device having a 4×4 array of playing positions, and wherein each playing position includes two LED indicators that are housed in one compartment with a diffused lens.
Figure 3:
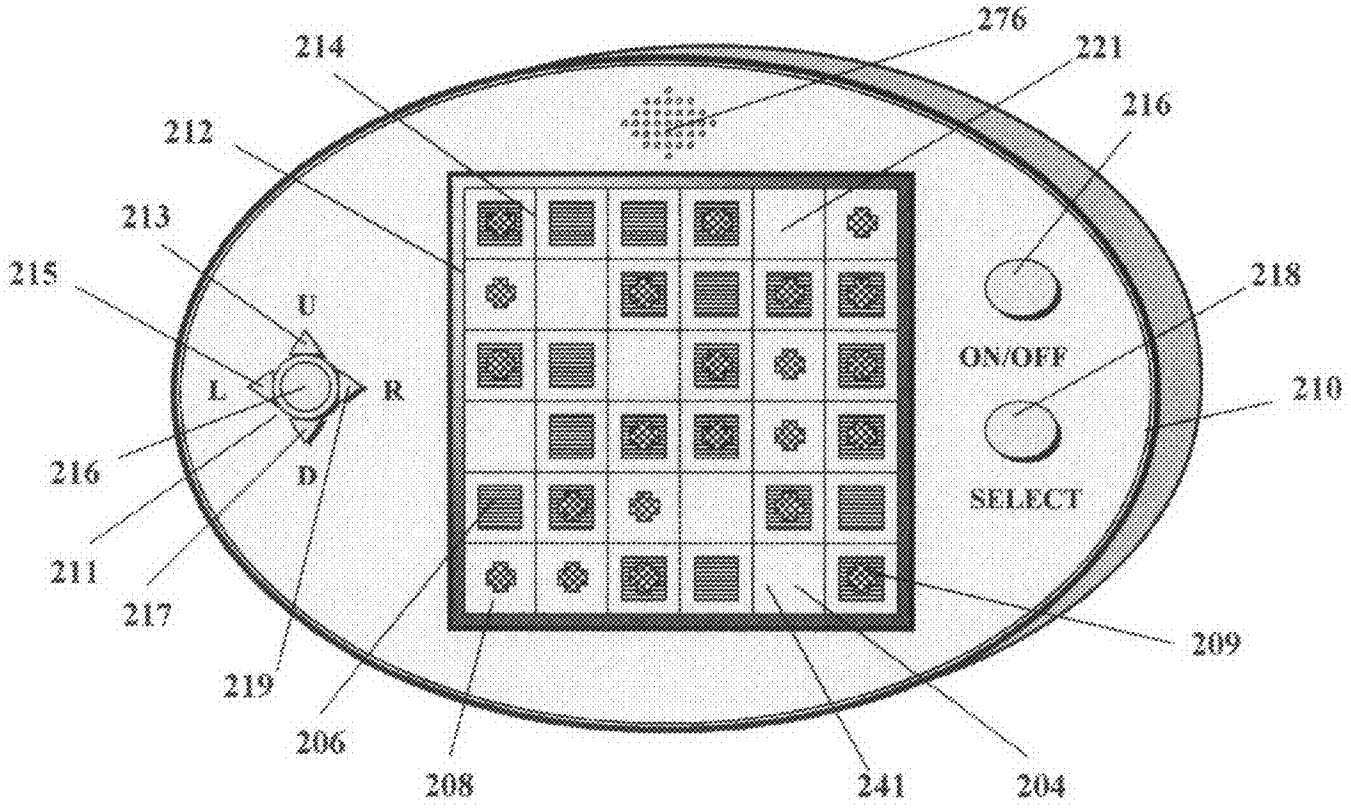
FIG. 3 is a perspective view of a preferred embodiment of a puzzle device using an LCD screen that is subdivided into 6×6 playing positions.

Referring now to the drawings where the illustrations are for the purpose of describing a number of preferred embodiments of the invention, and are not intended to limit the invention hereto. FIGS. 1, 2 & 3 are perspective views of preferred embodiments of an electronic hand-held puzzle device that employs two-dimensional arrays of indicators. The size of said two-dimensional arrays of indicators is a design choice, however, for illustration purposes FIG. 1 indicates a puzzle device 10 that employs a 5×5 array of playing positions using LED indicators, wherein each playing position employs LED indicators that are segregated from each other; FIG. 2 shows a puzzle device 110 using a 4×4 array of playing positions using LED indicators, wherein each playing position employs LED indicators that are housed in a single compartment; and FIG. 3 indicates a puzzle device 210 using an LCD screen 212 subdivided into 6×6 playing positions The number of different visual indications (colors or images) provided by these two-dimensional devices is a design choice, and is dependent on the number of indicating elements per indicator, and the number of indicating states per indicating element. For the purpose of describing the preferred embodiments, each indicator in these devices has two indicating elements, and in turn each indicating element has two indicating states. With respect to the device shown in FIG. 1, each indicator includes two LED's of different colors that are segregated from each other such that the first colored light emitted from one LED (color #1) is not mixed with the second colored light emitted from the other LED (color #2). Accordingly, the surface of the indicator has two segregated areas 3 & 5, wherein the first area 3 is illuminated by the first LED (color #1), and the second area 5 is illuminated by the second LED (color #2). For the preferred embodiment shown in FIG. 1, the first area 3 has a rectangular shape, and the second area 5 has a circular shape, and is centered inside the first area. For this preferred embodiment, the color reflected from the surface of the first area is the same color as the color reflected from the surface of the second area (color #3). However, as would be appreciated by a person skilled in the art, a game designer may elect to make these two reflected colors different.

For the preferred embodiment shown in FIG. 1, the first visual indication is generated when both LED elements are de-energized, and consists of the reflected color from the surface of both the first and the second areas (color #3). The second visual indication is produced when the first LED element is energized, and the second LED element is de-energized. In such a case, the visual indication consists of a first color of light corresponding to the first LED element that is emitted from the first area (color #1), and a second color that is reflected from the second area (color #3). Similarly, the third visual indication is produced when the first LED element is de-energized, and the second LED element is energized. Said third visual indication is in the form of a color reflected from the first area (color #3), and a color emitted from the second area (color #2) that corresponds to the second LED element. The fourth visual indication is produced when both LED elements are energized. In such a case, the first area emits a color of light that corresponds to the first LED (color #1), and the second area emits a color of light that corresponds to the second LED (color #2).

With respect to the preferred embodiment shown in FIG. 2, each indicator includes two LEDs of different colors (color #1 & color #2) that are housed in one compartment, which includes a diffused lens 104. Alternatively, each indicator could include a single LED with two internal LED elements of different colors. Similar to the embodiment shown in FIG. 1, there are four different visual indications for each indicator. The first visual indication is generated when both LED elements are de-energized, and consists of the reflected color from the surface of the indicator (color #3). The second visual indication is produced when the first LED element is energized, and the second LED element is de-energized. In such a case, the visual indication consists of a first color of light corresponding to the first LED element (color #1). Similarly, the third visual indication is produced when the first LED element is de-energized, and the second LED element is energized. Said third visual indication is in the form of a second color of light that corresponds to the second LED element (color #2). The fourth visual indication is produced when both LED elements are energized. In such a case, the indicator emits a color of light Color #4) that is produced by combining the two different emitted colors (color #1 & color #2) from the two LED elements, using the diffused lens 104. For example, if the first LED element emits the color red, and the second LED element emits the color green, when both LED elements are energized the indicator will emit the color yellow.

As would be appreciated by one skilled in the art, the LED device shown in FIG. 2 could also be built to operate with only three visual indications. This is achieved for example by a first LED that has two indicating states, and wherein one of the indicating states corresponds to a first emitted color (color #1), and the second indicating state corresponds to a dark indication. The second LED also has two indicating states, wherein the first indicating state corresponds to said first emitted color (color #2), and the second indicating state corresponds to a second emitted color (color #1). In such case, the three visual indications consist of a first emitted color from the first LED (color #1), a second emitted color from the second LED (color #2), and the first and second emitted colors superimposed on each other (color #3), i.e., no dark indication.

The specific colors used for the device shown in FIG. 1 are red, green, and white. The white color is un-illuminated, and is produced when both LED elements at a playing position are dark. In such a case, the four visual indications at an indicator include white/white 4, green/white 6, white/red 3, and green/red 9. Similarly, the colors used for the device shown in FIG. 2 are white, red, green and yellow. In such a case, the four visual colors at an indicator include white, red, green, and yellow. If a three-color device is constructed, then the visual indications include red, green, yellow, and no dark indication.

With respect to the LCD device shown in FIG. 3, the screen 212 is configured as an array of 6×6 playing positions, and each playing position is associated with a sector on the screen (indicator) 214 whereon a plurality of images could be indicated. Similar to the LED devices, there are two different images that could be displayed at each playing position, and each image has two indicating states, present and absent. Accordingly, each playing position can provide four different visual indications. The first visual indication is a blank indication 204, and occurs when both images are absent. The second visual indication consists of the first image 206, and occurs when the first image is present and the second image is absent. Similarly, the third visual indication consists of the second image 203, and occurs when the first image is absent, and the second image is present. The forth visual indication consists of both images 209, and occurs when both images are present.

Each of the devices shown in FIGS. 1, 2 & 3 has a control point at each playing position. The control point could be implemented by a momentary switch associated with an indicator as shown in FIGS. 1 & 2. Accordingly, with respect to device shown in FIG. 1, each playing position has a lighted momentary switch 41, which also provides the second indicating area 5. Similarly, the device shown in FIG. 2 has a lighted momentary switch 41 at each playing position such that both LED indicators are housed in the compartment of the switch. Said momentary lighted switch 41 has a diffused lens 104, which provides a single indicating area per playing position.

Alternatively, the control points at the various playing positions could be provided by a mouse control mechanism as shown in FIG. 3. A mouse control mechanism 211 has a plurality of directional controls "UP" 213, "LEFT" 215, "DOWN" 217 & "RIGHT" 219 to enable a player to select a playing position by placing a cursor at the playing position, and a momentary switch 216 to activate the selected playing position. It should be noted that for the device shown in FIG. 3, a game designer may elect to implement the control points using touch screen controls 241 rather than the mouse control mechanism 211.

The main concept of this invention is to associate each control point with a plurality of indicators on the playfield to form a plurality of geometric patterns, wherein each indicator has a plurality of independent indicating elements.

In a device that employs two indicating elements per indicator, when the player activates a control point, at least one indicator in the associated geometric pattern will have its first indicating element reversed, and at least a different indicator in the geometric pattern will have its second indicating element reversed. For an LED device, reversing an indicating element means changing the status of an LED from "ON" to "OFF," or from "OFF" to "ON." However, the reversing, or switching, could also be between two different emitted colors rather than between the "ON" and "OFF" states of an LED element. Similarly, for the LCD device shown in FIG. 3, reversing an indicating element means changing the status of an image from "PRESENT" to "ABSENT," or from "ABSENT" to "PRESENT." However, similar to the LED example, the reversing or switching could be between two different images, rather than between the "PRESENT" and "ABSENT" states of a single image.

Figure 4:
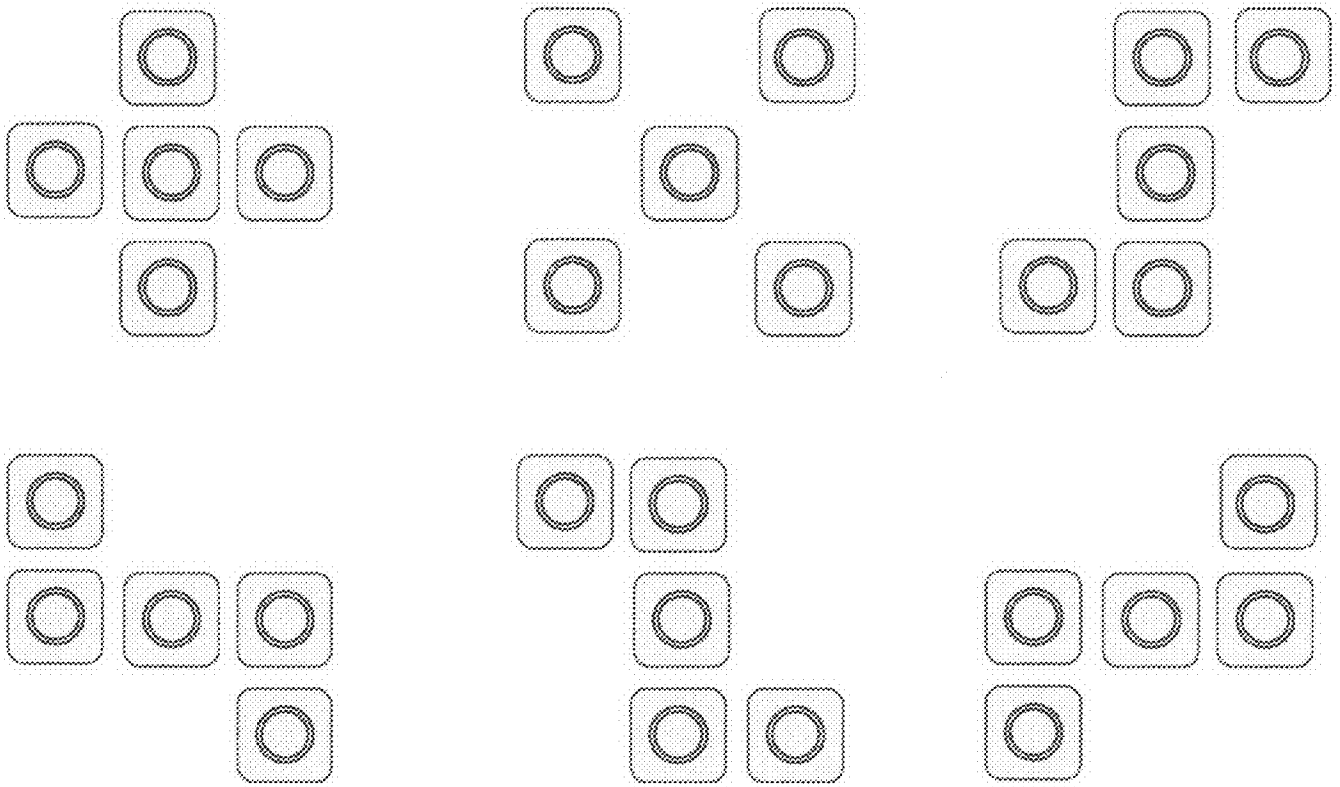
FIG. 4 shows six (6) examples of geometric patterns that can be used for the two dimensional array devices indicated in FIGS. 1, 2 & 3.

As would be appreciated by one skilled in the art, the specific geometric pattern used in an embodiment is a design choice. Similarly, it is a matter of design choice to configure which indicators within the geometric pattern would have their first indicating elements reversed, and which indicators within the geometric pattern would have their second elements reversed, etc., when the associated control point is activated. For the preferred embodiments shown in FIGS. 1, 2 & 3, any of the geometric patterns shown in FIG. 4 could be used.

For the purpose of describing the preferred embodiments, the "+" geometric pattern is used for the embodiments shown in FIG. 1, and the "X" geometric pattern is used for the embodiment shown in FIGS. 2 & 3. It should be noted that the use of the "+" and "X" geometric patterns to describe these preferred embodiments is for demonstration purposes only, and is not intended to limit the invention herein. As would be appreciated by a person skilled in the art, any geometric pattern that that includes at least two playing positions could be used to implement this invention.

Figure 5:
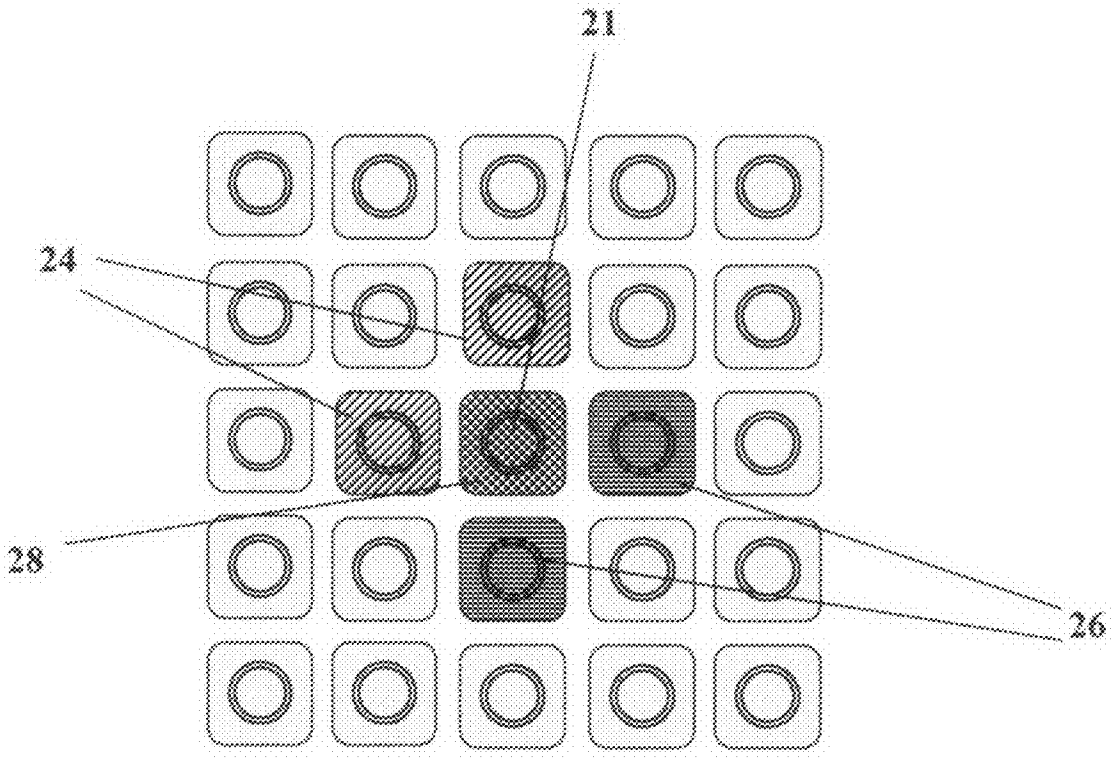
FIG. 5 indicates the five (5) playing positions of a "+" geometric pattern employed by the preferred embodiment shown in FIG. 1.

The "+" geometric pattern shown in FIG. 5 includes 5 playing positions. The control point is located at the center position, and the five indicators are located at the center, top, right, bottom, and left positions. Further, when the control point is located at the perimeter of the playfield of a two dimensional device, the geometric pattern wraps around the playfield as indicated by the examples shown in FIG. 6.

For the device shown in FIG. 1, the operation of the geometric pattern shown in FIG. 5 is such that when the control point 21 is activated, the first LED element at the top & left indicators 24 are reversed, the second LED element at the right & bottom indicators 26 are reversed, and both LED elements at the center indicator 28 are reversed. There are four possible initial visual indications at the top and left indicators, namely, dark/dark, red/dark, dark/green, and red/green. Because the second LED elements at the top and left indicators are not affected by an activation of the control point, it follows that upon the activation of the control point, the initial visual indications of dark/dark, red/dark, dark/green, and red/green are transformed to red/dark, dark/dark, red/green, and dark/green respectively. Similarly, because the first LED element at the right and bottom indicators is not affected by an activation of the control point, it follows that upon the activation of the control point, the initial visual indications of dark/dark, red/dark, dark/green, and red/green are transformed to dark/green, red/green, dark/dark, and red/dark respectively. With respect to the center indicator, an activation of the control point transforms the initial visual indications of dark/dark, red/dark, dark/green and red/green to red/green, dark/green, red/dark, and dark/dark respectively. The above stated rules are summarized in the three tables shown in FIG. 7.

Figure 8:
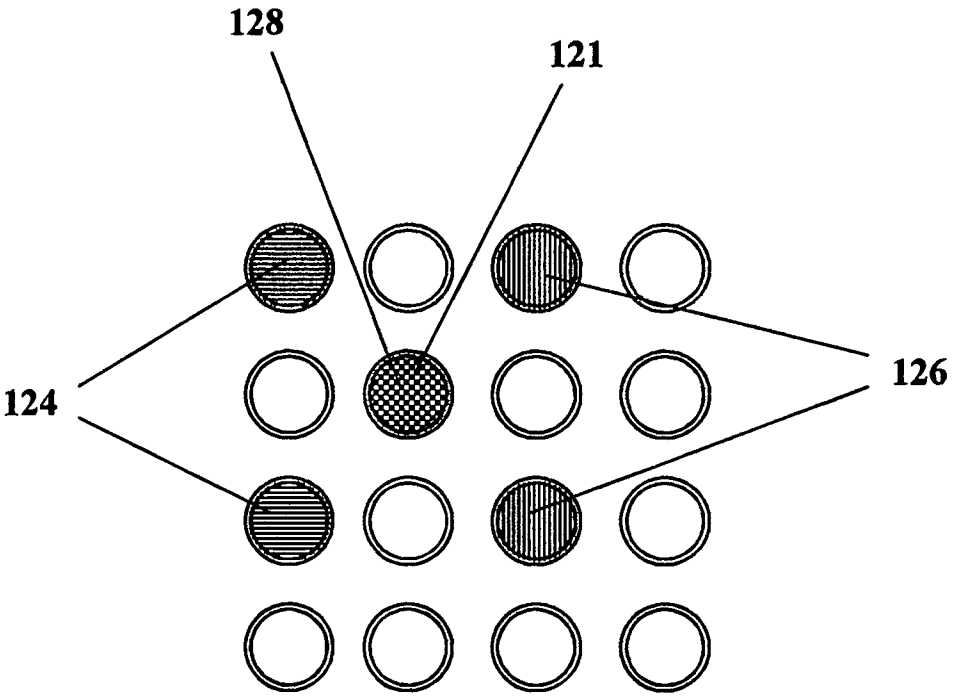
FIG. 8 indicates the five (5) playing positions of a "X" geometric pattern employed by the preferred embodiment shown in FIG. 2.
Figure 9:
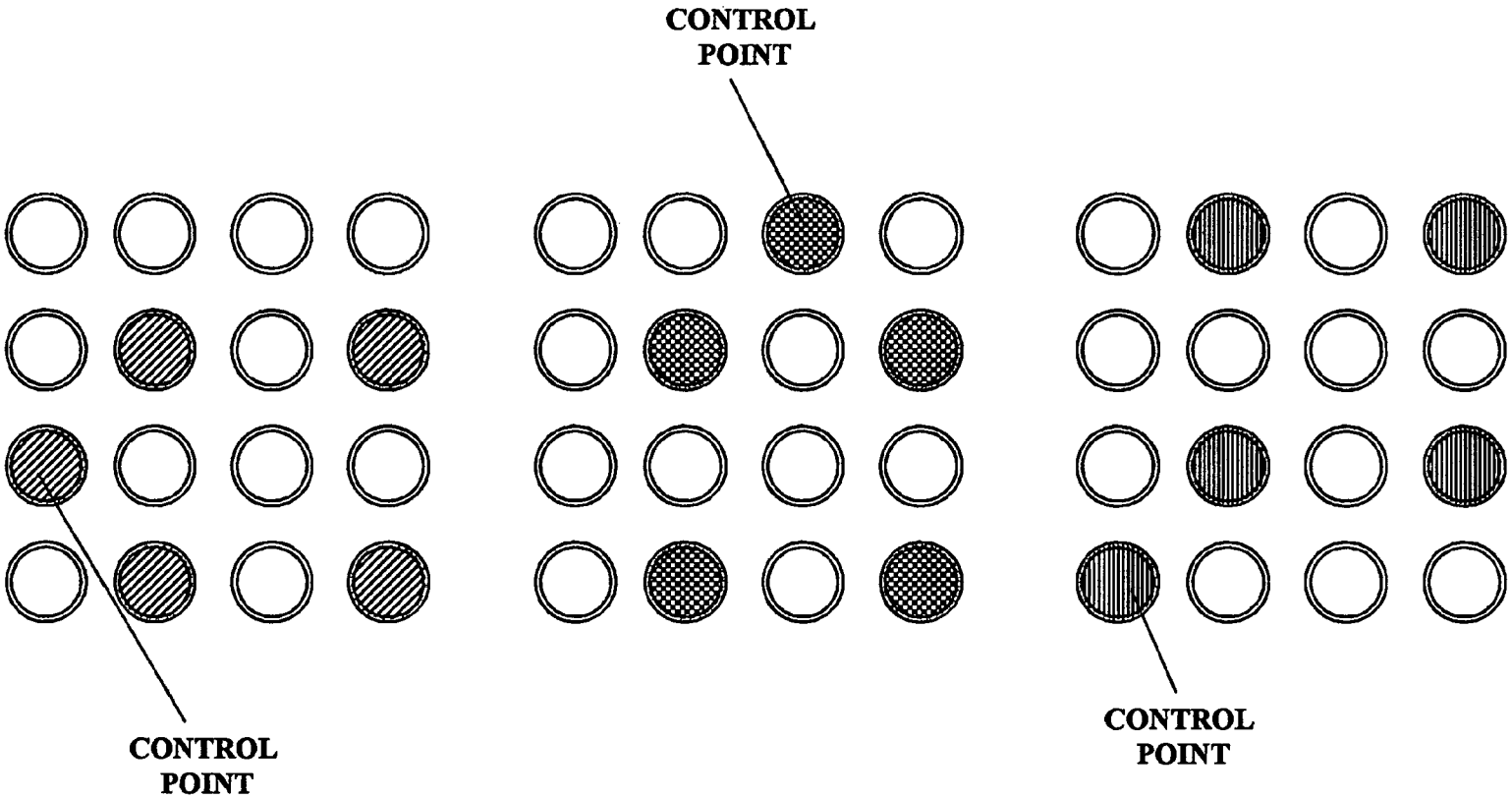
FIG. 9 indicates examples of the "X" geometric pattern when the associated control point is located at the perimeter of a two dimensional playfield.

Similarly, the "X" geometric pattern shown in FIG. 8 includes 5 playing positions. The control point is located at the center position 121, and the five indicators are located at the center, top left, top right, bottom left, and bottom right positions. Further, when the control point is located at the perimeter of the playfield, the geometric pattern wraps around the playfield as indicated by the examples shown in FIG. 9.

For the device shown in FIG. 2, the operation of the geometric pattern shown in FIG. 8 is such that when the control point 121 is activated, the first LED element at the top left & bottom left indicators 124 are reversed, the second LED element at the top right & bottom right indicators 126 are reversed, and both LED elements at the center indicator are reversed 128. There are four possible initial visual indications at the top left and bottom left indicators 124, namely, dark, red, green, and yellow. Because the second LED elements at the top left and bottom left indicators 124 are not affected by an activation of the control point, it follows that upon the activation of the control point, the initial visual indications of dark, red, green, and yellow are transformed to red, dark, yellow, and green respectively. Similarly, because the first LED element at the top right and bottom right indicators 126 is not affected by an activation of the control point, it follows that upon the activation of the control point, the initial visual indications of dark, red, green, and yellow are transformed to green, yellow, dark, and red respectively. With respect to the center indicator 1128, an activation of the control point transforms the initial visual indications of dark, red, green and yellow to yellow, green, red, and dark respectively. The above stated rules are summarized in the three tables shown in FIG. 10.

Each of the preferred embodiments shown in FIGS. 1, 2 & 3 can provide a plurality of puzzles. A puzzle is defined by an objective related to the states of the indicators on the playfield. For example, an objective of a puzzle could be to have all the indicators on the playfield reach the same indicating state, i.e., indicating the same color or image. Alternatively, an objective of a puzzle could be to have a first group of indicator reaching one indicating state, a second group of indicators reaching a second indicating state, a third group of indicator reaching a third indicating state, etc. For the purpose of demonstrating the preferred embodiments, the various puzzles are defined by an objective that requires all the indicators to reach the same indicating states. For example, the device shown in FIG. 1 could provide four (4) different puzzles. The first puzzle is defined by the objective of having all indicators on the playfield emit the red color. Similarly, the second puzzle is defined by the objective of having all indicators emit the color green. The third puzzle is to have all indicators dark, i.e., reflecting the color white at the surface of the indicators. The fourth puzzle is to have all indicators emit the two colors red/green. Similar objectives are defined for the device shown in FIG. 2. With respect to the device shown in FIG. 3, the objective of a puzzle is to have all indicators on the playfield display the same image, or an assigned part of an image such as in the event of a jigsaw puzzle implementation.

A game for a specific puzzle is defined by an initial condition presented to the player in the form of an initial display. The player is then challenged to transform such initial display to the desired display that defines the objective of the puzzle. Each of the devices shown in FIGS. 1, 2 & 3 provides a plurality of games for each puzzle. The data for the various games is stored in a data section of the control program located in the read only memory (ROM) of the micro-processor that controls the operation of the device. The data for a specific game consists of the initial display states for all indicating elements, at all indicators on the playfield. As would be appreciated by one skilled in the art, the games for a particular puzzle could be grouped in a plurality of difficulty levels of play. Such grouping could be based on the number of steps needed to transform the initial display to the final display defined by the objective of the puzzle.

The LCD screen 212 for the preferred embodiment shown in FIG. 3 could be monochromic or colored. However, for the purposes of describing this preferred embodiment, a colored screen is used. The specific type of screen used is a design choice. As would be appreciated by a person of ordinary skills in the art, LCD, Plasma, DLP, or any other type of colored screens could be used. It is also preferable to provide backlighting for the screen. The specific visual indications provided by this embodiment are also a design choice. Any images that are distinguishable from each other, either by color or shape, could be used. For the purpose of describing the preferred embodiment shown in FIG. 3, the visual indications used include two geometric images, namely a green square and a red cross that is positioned inside the square. For a monochromic LCD screen the square and the cross could be implemented using different shades of gray.

Figure 11:
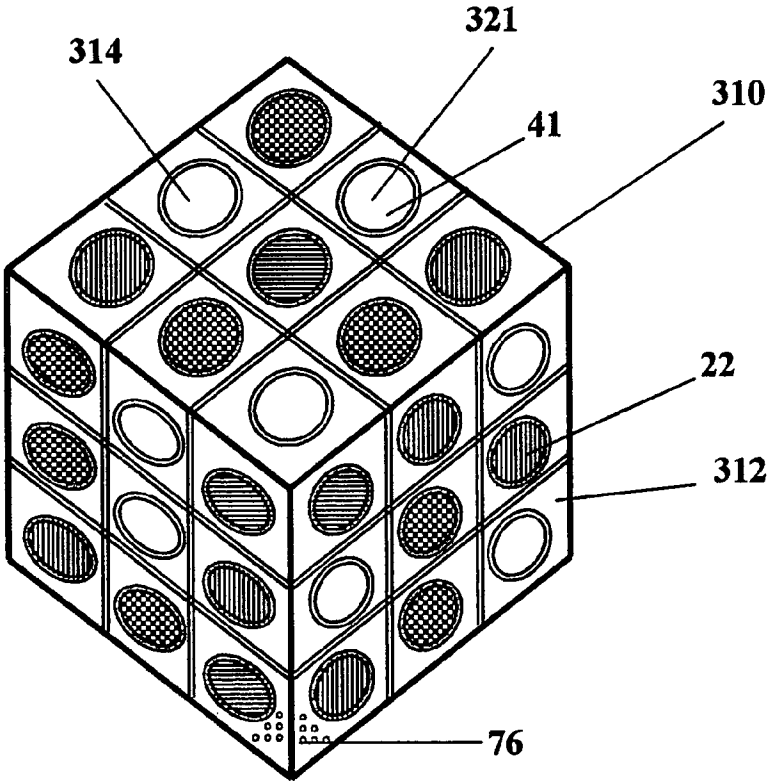
FIG. 11 is a perspective view of a preferred embodiment of a puzzle device using LEDs, and shaped as a cube, wherein each side of the cube is subdivided into 3×3 playing positions.

The general concept described herein could also be implemented using three dimensional housings. For example FIG. 11 is a perspective view of an electronic hand-held puzzle device 310 shaped as a cube, and comprised of a housing 312 having six sides, each of which carrying an array of 3×3 playing positions. In turn, each playing position has an indicator 3114, and a control point 321 that is implemented by a momentary switch 41. Further, each indicator has two indicating elements. The first indicating element is implemented by a first color LED (red for the cube embodiment), and the second indicating element is implemented by a second color LED (green for the cube embodiment). The indicating elements are housed in one compartment so that the two emitted colors could be mixed together. It is preferable that the indicating elements and the momentary switch be implemented by a lighted switch 41. Each indicator can then provide four (4) different visual indications, namely red, green, yellow and dark (i.e. a reflected color). Also, rather than employing separate on/off and select switches, these functions could be implemented by the simultaneous activation of control points located on the cube device.

Figure 12:
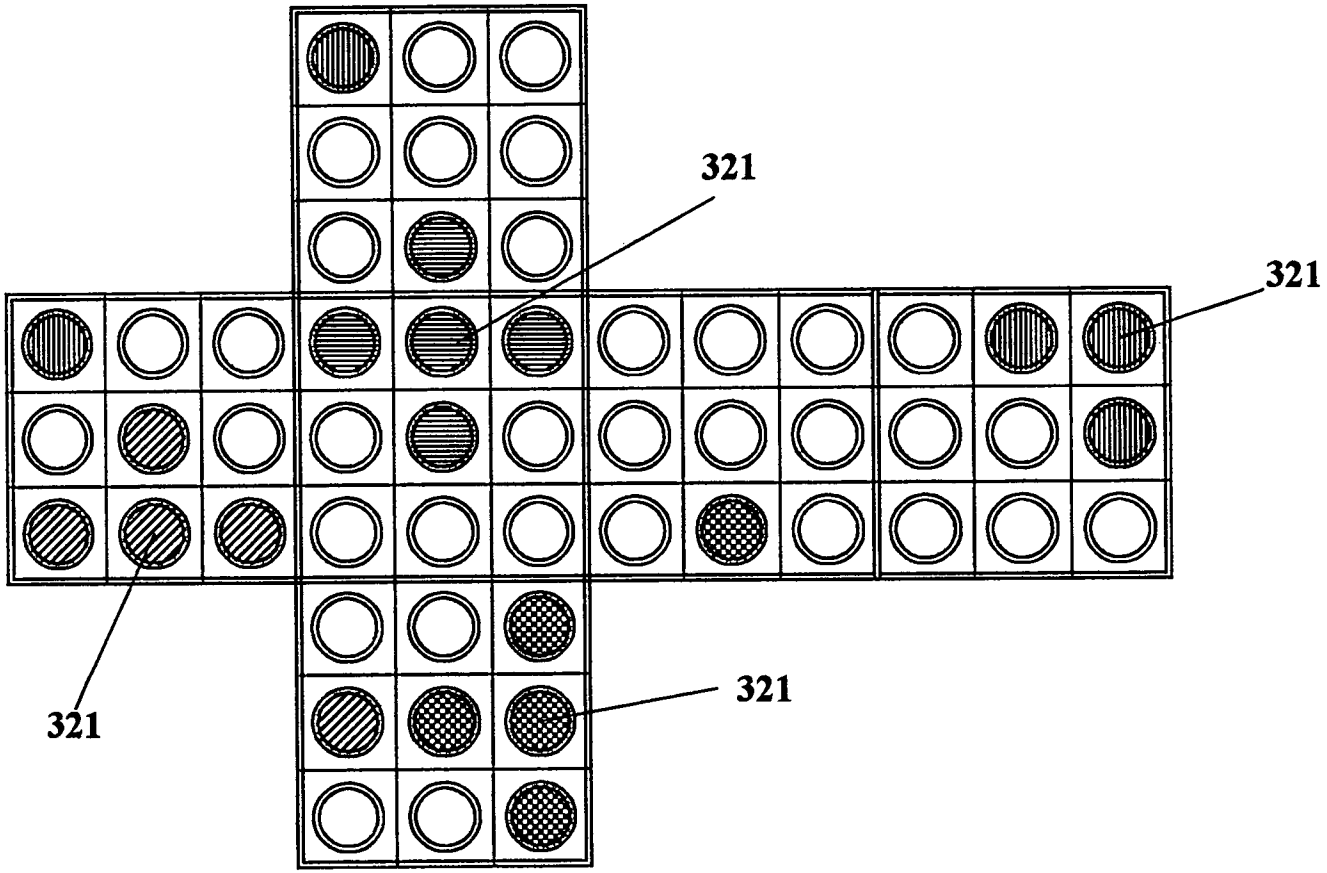
FIG. 12 indicates examples of the "+" geometric pattern when the associated control point is located at a playing position at the edge of the cube device shown in FIG. 11.

This cube device employs the "+" geometric pattern used for the two dimensional device shown in FIG. 1. Accordingly, the operation of the cube device is governed by the same rules shown in FIG. 7. Further, when a control point 321 is located at a playing position on a perimeter of one of the cube faces, i.e., at an edge of the cube, the geometric pattern wraps around the adjacent side or sides as shown in FIG. 12.

The cube device provides a plurality of puzzles, including a puzzle with the objective of having the indicators at each pair of opposite sides attain a different color. For example, and since a cube has 6 sides, an objective of a puzzle could be an indicating state wherein all the indicators at sides 1 & 3 display red, all the indicators at sides 2 & 4 display green, and all the indicators at sides 5 & 6 display yellow. An alternate example of a puzzle objective could substitute one of the emitted colors with a reflected color, i.e. the color of the surface of the indicator when the indicator is dark. As would be appreciated by one skilled in the art, another objective of a puzzle could be based on having all indicators at all six sides of the cube displaying the same color.

Similar to the two dimensional devices shown in FIGS. 1, 2 & 3, the cube device shown in FIG. 11 provides a plurality of games for each puzzle. A game is defined by an initial display pattern presented to the player, and a game objective. The initial display pattern for a particular game is established by starting with a display that corresponds to a game objective, and by activating one or a plurality of control points in order to scramble the display. The resulting display then becomes the initial pattern that is presented to the player at the beginning of the game. The initial patterns for games could be stored as program data in the read only memory of the microprocessor that controls the device, in the form of initial indicating states for all fifty-four indicators. Alternatively, the initial pattern could be stored in memory as data describing the specific switch activations required to produce the initial pattern from a game objective.

Figure 13:
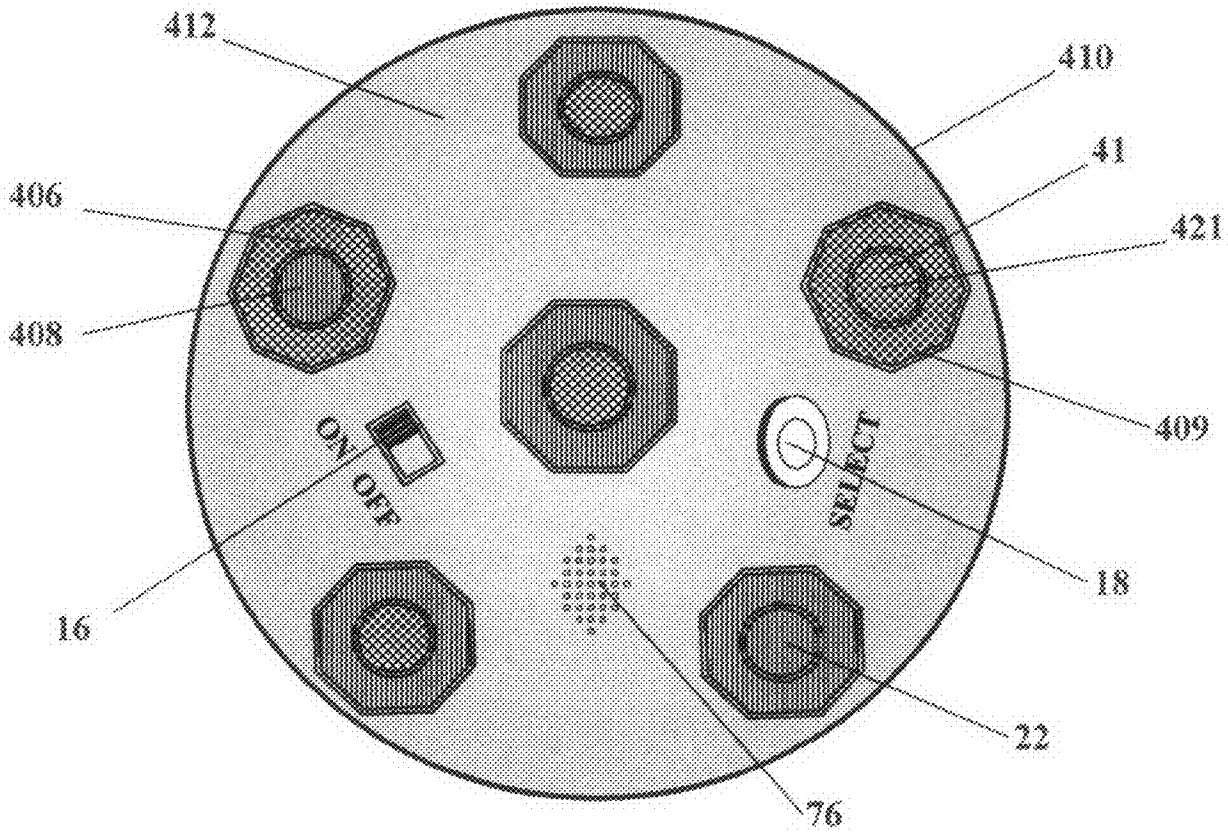
FIG. 13 is a perspective view of a preferred embodiment of a puzzle device using LEDs, shaped as a sphere, and includes 12 playing positions that are equally spaced on the surface of the sphere.

The general concept described herein could also be implemented using a puzzle device in the shape of a sphere as shown in FIG. 13. Such device 410 includes a housing 412 having a plurality of playing positions 409. In turn, each playing position includes an indicator, and a control point 421 that is implemented using a momentary switch 411. Further, each indicator has two indicating elements that are implemented using light emitting diodes. The first indicating element has a hexagon shaped lens 406 located on the surface of the sphere, and is implemented by a first color LED (yellow for the sphere preferred embodiment), and the second indicating element has a circular lens 408 located in the middle of the hexagon lens, and is implemented by a second color LED (blue for the sphere preferred embodiment). The indicating elements are segregated from each other to prevent the two emitted colors (yellow and blue) from being mixed with each other. Each indicator can then provide four (4) different visual indications, namely yellow, blue, blue/yellow and dark (i.e. a reflected color). The momentary switch mechanism that implements the control point 421 is integrated in the second indicating element 408. Which means that the second indicating element 408, and the control point 421 are implemented by a lighted switch 41.

Figure 14:
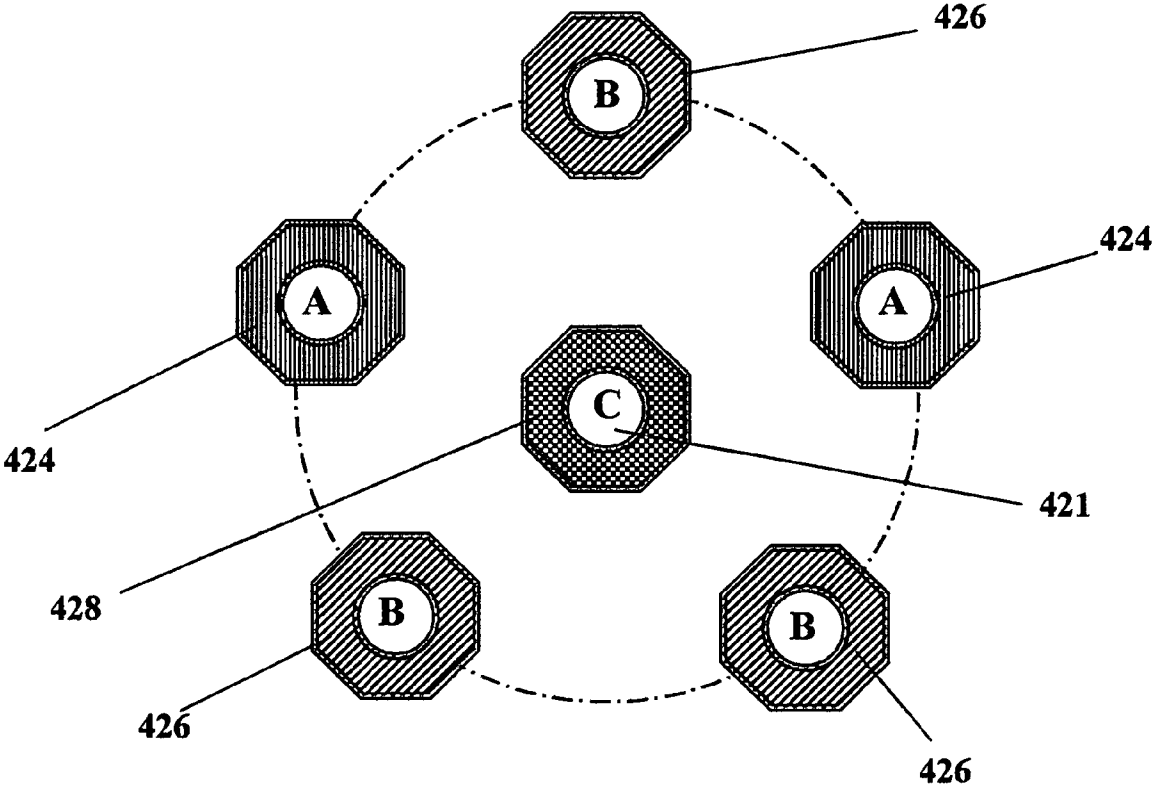
FIG. 14 indicates an example of a circular geometric pattern employed by the sphere preferred embodiment shown in FIG. 13, and which includes six (6) playing positions with associated indicators that are configured as "A," "B," and "C" indicators.

This sphere device employs a geometric pattern in the form of a circular ring of indicators together with the indicator at the center (origin) of the ring as shown in FIG. 14. The number of indicators on the surface of the sphere is a design choice. However, this preferred embodiment employs twelve (12) indicators that are equally spaced on the surface of the sphere such that the circular ring that provides the geometric pattern includes five indicators.

The operation of the geometric pattern for the sphere device is such that when the control point at the center of the geometric pattern 4 is activated, the first LED element at two predetermined indicators ("A" indicators 424) located on the ring are reversed, the second LED element at the remaining three indicators ("B" indicators 426) on the ring are reversed, and both LED elements at the center indicator ("C" indicator 428) are reversed. FIG. 14 shows a general configuration of this geometric pattern, and indicates the "A," "B," and "C" indicators. There are four possible initial visual indications at the "A" indicators 424, namely, dark/dark, dark/yellow, blue/dark, and blue/yellow. Because the second LED elements at the "A" indicators 424 are not affected by an activation of the control point, it follows that upon the activation of the control point, the initial visual indications of dark/dark, dark/yellow, blue/dark, and blue/yellow are transformed to dark/yellow, dark/dark, blue/yellow, and blue/dark respectively. Similarly, because the first LED element at the "B" indicators 426 is not affected by an activation of the control point, it follows that upon the activation of the control point, the initial visual indications of dark/dark, dark/yellow, blue/dark, and blue/yellow are transformed to blue/dark, blue/yellow, dark/dark, and dark/yellow respectively. With respect to the "C" indicator 428, an activation of the control point transforms the initial visual indications of dark/dark, dark/yellow, blue/dark and blue/yellow to blue/yellow, blue/dark, dark/yellow, and dark/dark respectively. The above stated rules are summarized in the three tables shown in FIG. 15.

Similar to the other devices disclosed herein, the sphere device provides a plurality of puzzles, including a puzzle with the objective of having all indicators dark, a puzzle objective of having all indicators emitting the first color yellow, a puzzle objective of having all indicators emitting the second color blue, and a puzzle with an objective of having all indicators emitting the two colors blue/yellow. As would be appreciated by one skilled in the art, other puzzle objectives could be based on a first group of indicators attaining one color, and a second group of indicators attaining a second color, etc. It should also be noted that the colors yellow and blue are used for the purpose of describing the sphere embodiment, and is not intended to limit the invention herein. As would be appreciated by a person skilled in the art, any other colors could be used. Further, a game designer may elect to use a bi-color LED at each indicating element. For example, the first indicating element could be implemented using a green/red LED, and the second indicating element could be implemented using a blue/yellow LED. In such a case, each indicator can provide four (4) visual indications as follows: blue/green, blue/red, yellow/green, and yellow/red. Another variation could employ the same bi-color LED at both indicating element, say red and green. In such a case, each indicator can also provide four (4) visual indications as follow: green/green, red/green, green/red, and red/red.

Similar to other puzzle devices presented herein, a game for a specific puzzle for the sphere device is defined by an initial display that is presented to the player. The player is then challenged to transform said initial display to the desired display that defines the objective of the puzzle. The sphere device shown in FIG. 13 provides a plurality of games for each puzzle. The data for the various games is stored in a data section of the control program located in the read only memory (ROM) of the microprocessor that controls the operation of the device. The data for a specific game consists of the initial display states for all indicating elements, at all indicators on the playfield. As would be appreciated by one skilled in the art, the games for a particular puzzle could be grouped in a plurality of difficulty levels of play. Such grouping could be based on the number of steps needed to transform an initial display to the final display defined by the objective of the puzzle. One method to generate an initial display for a game is to start with a playfield that reflects a game objective, and activate a plurality of control points to generate a display that becomes an initial display. To solve the game, a player needs to activate the same control points to reach the objective of the puzzle.

Figure 16:
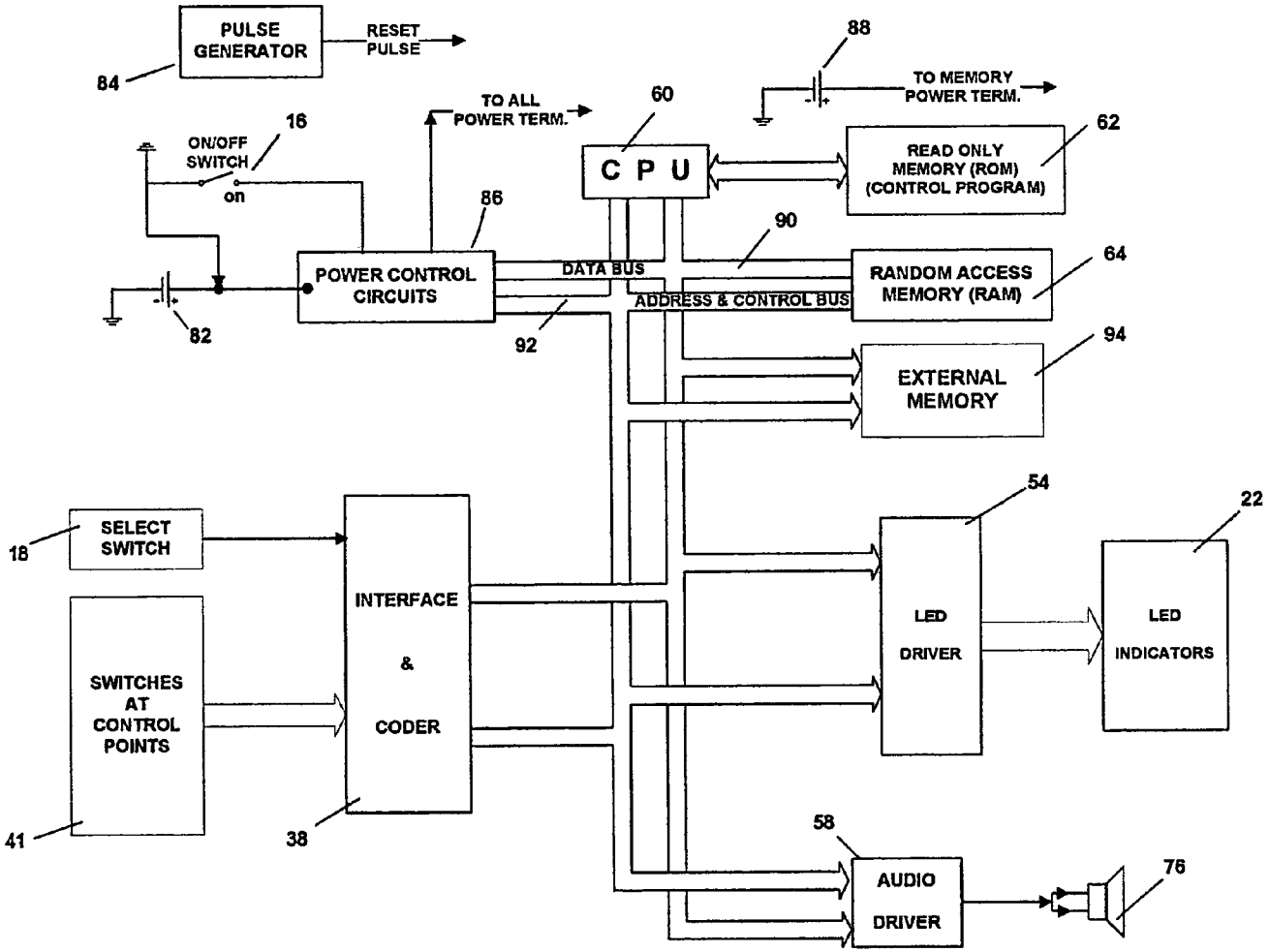
FIG. 16 is a block diagram of a microprocessor circuits utilized by the present invention for the embodiments that employ LED indicators, and which are indicated in FIGS. 1, 2, 11 & 13.

Each of the devices shown in FIGS. 1, 2, 11 & 13 employs a microprocessor and associated circuits as indicated by the block diagram shown in FIG. 16. This block diagram includes a central processing unit 60 having a control program residing in a read only memory (ROM) 62, an external FLASH memory 94 that contain additional puzzles and/or games, a random access memory (RAM) 64, an interface and coding device 38, an LED driver 54, and audio interface and control circuits (audio driver) 58. The interface and coding device 38 is used as input interface between the switches that implement the control points 41, the select switch 18, and the central processing unit 60. In contrast, the LED driver 54 is used as an output interface between the central processing unit 60 and the LED displays 22. Similarly, the audio driver 58 is used as output interface between the central processing unit 60 and the loudspeaker 76. A common address and control bus 92, and a separate common data bus 90 are used to interconnect the central process unit 60 with the interface and coding device 38, the LED driver 54, the audio driver 58, the read only memory (ROM) 62, the random access memory (RAM) 64, and the external memory device 94. An ON/OFF switch 116 is used to connect a main battery 82 to the power control circuits 86. A second optional battery 88 could be used to supply electrical energy to memory devices. The select switch 18 is pressed a first time to select a puzzle, and a second time to select a game. Further, the audio circuits together with the speaker 76 are used to generate audio effects during game play.

Figure 17:
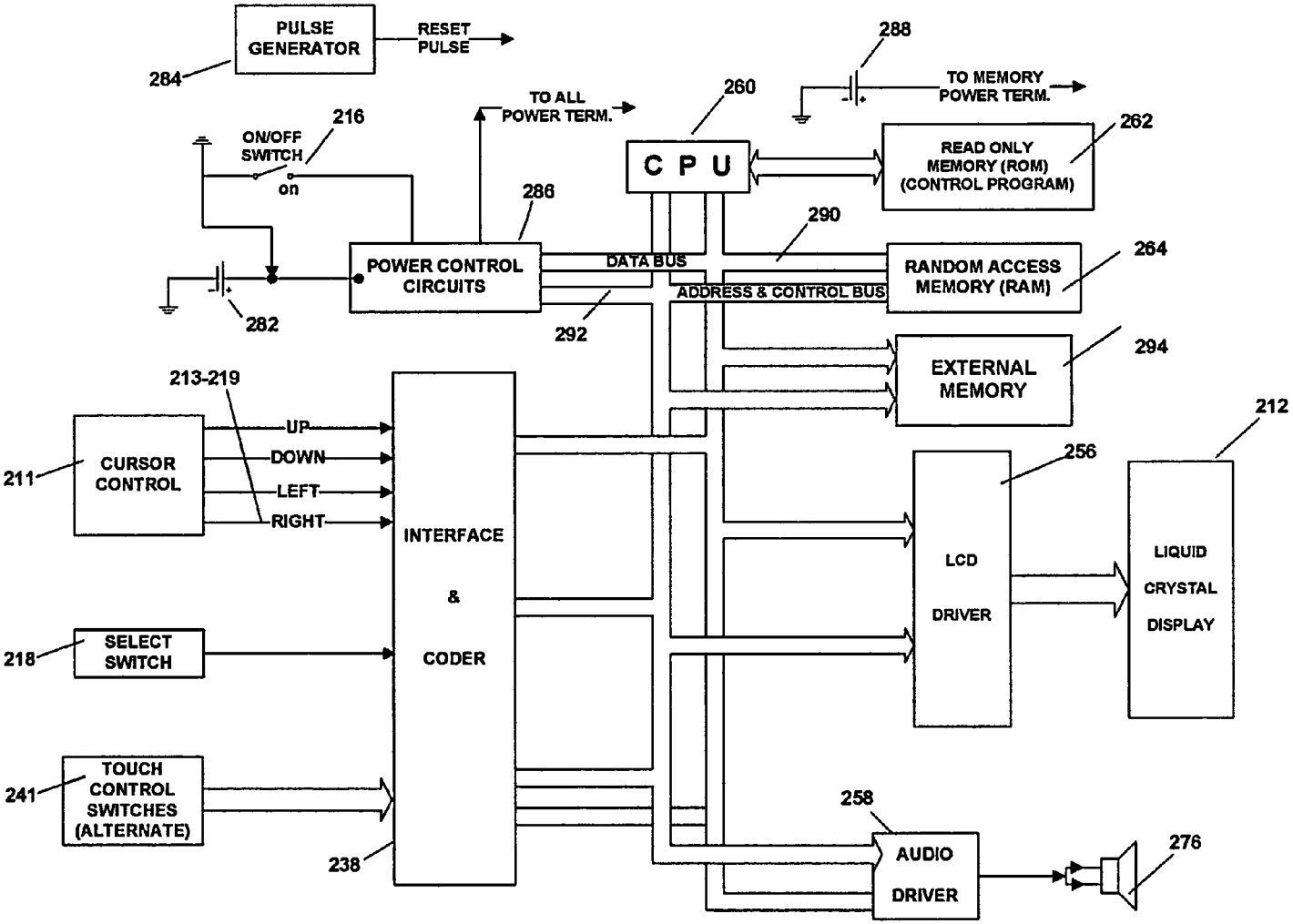
FIG. 17 is a block diagram of a microprocessor circuits utilized by the present invention for the embodiment that employs an LCD screen, and which is indicated in FIG. 3.

With respect to the device shown in FIG. 3, it employs the block diagram shown in FIG. 17. This block diagram is similar to the diagram shown in FIG. 16, and includes a central processing unit 260 having a control program residing in a read only memory (ROM) 262, an external FLASH memory 294 that contain additional puzzles and/or games, a random access memory (RAM) 264, an interface and coding device 238, an LCD driver 254, and audio interface and control circuits (audio driver) 258. The interface and coding device 238 is used as input interface between the switches that implement the mouse control mechanism 213, 215, 216, 217 & 219, the select switch 218, and the central processing unit 260. Alternatively, the control and coding device 238 could be used as an input interface between the touch control switches 241, which implement the control points 221, and the central processing unit 260. In contrast, the LCD driver 254 is used as an output interface between the central processing unit 260 and the LCD screen 212. Similarly, the audio driver 258 is used as output interface between the central processing unit 260 and the loudspeaker 276. A common address and control bus 292, and a separate common data bus 290 are used to interconnect the central process unit 260 with the interface and coding device 238, the LCD driver 254, the audio driver 258, the read only memory (ROM) 262, the random access memory (RAM) 264, and the external memory device 294. An ON/OFF switch 2116 is used to connect a main battery 282 to the power control circuits 286. A second optional battery could be used to supply electrical energy to memory devices. The select switch 218 is pressed a first time to select a puzzle, and a second time to select a game. Further, the audio circuits together with the speaker 276 are used to generate audio effects during game play.

It should be noted that the above description of the control circuits shown in FIGS. 16 & 17 is provided as an example for illustration purposes only, and is not intended to limit the present invention. As would be appreciated by those skilled in the art, a game designer would most likely select a micro-controller with built-in audio, LED and/or LCD drivers to control the game device. Such micro-controller would include I/O ports that can be configured as input or output ports, and could be used to connect the control switches directly to the micro-controller without the need for any interface and coding devices or memory decoder drivers. Such micro-controllers are well known to those skilled in the art.

As would be appreciated by a person of ordinary skills in the art, there are numerous embodiments, puzzles, and/or games that could be implemented using the general concept disclosed herein. The design parameters that define an embodiment and/or puzzle include the shape of the housing, the number of playing positions, the number of indicating elements per playing position, and the number of indicating states per indicating element. Further, the design parameters that define a game for a particular puzzle include the objective of the game, and the initial assignment of indicating states to the indicating elements at the playing positions. Additional features such as sound effects, means to vary the level of difficulty of play, a scoring system to measure a player's skill in solving various puzzles, etc., could also be incorporated in the various embodiments.

In addition, the puzzles and/or games described herein could be provided as a computer game on a CD, as a video game, or as a game on a hand held consumer electronic device.

Figure 18:
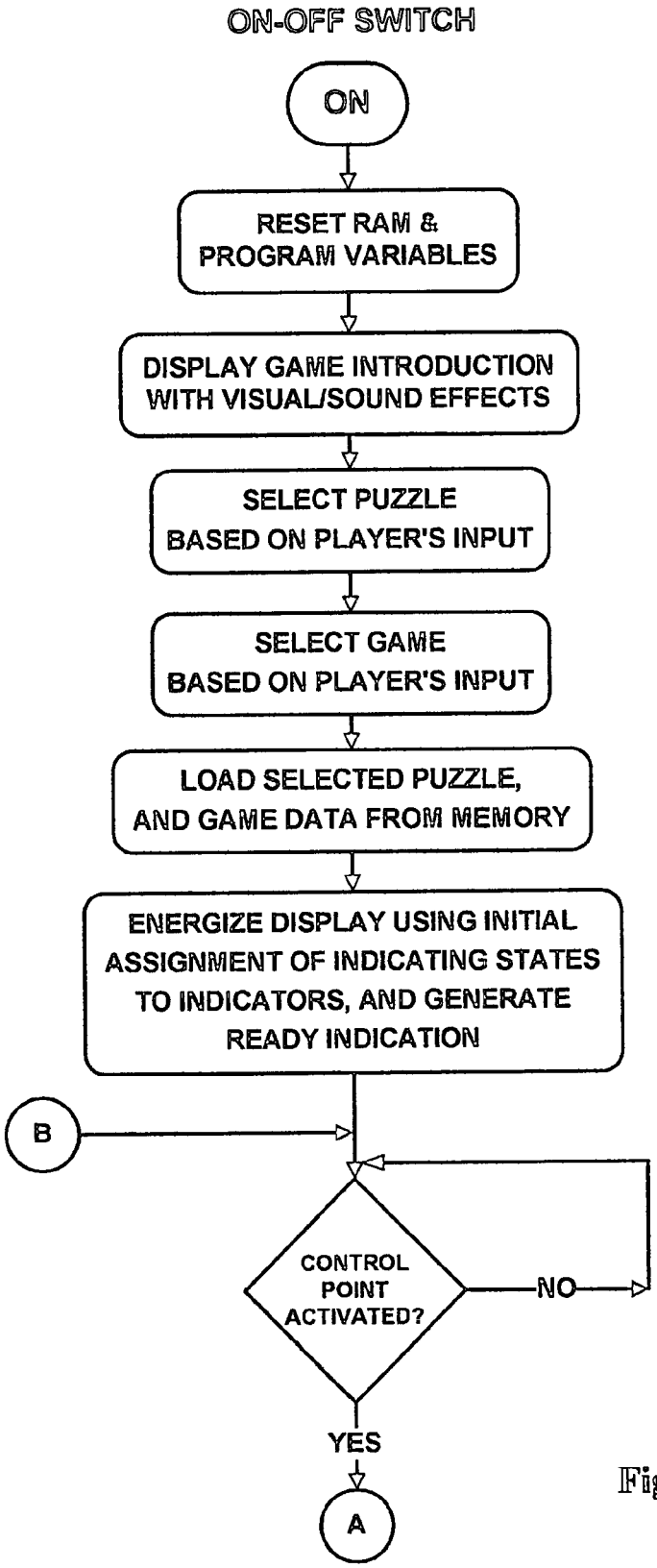
FIGS. 18 & 19 are logical flow diagrams illustrating the generic main program functions performed by the microprocessor controlling the operation of a game according to the invention.
Figure 19:
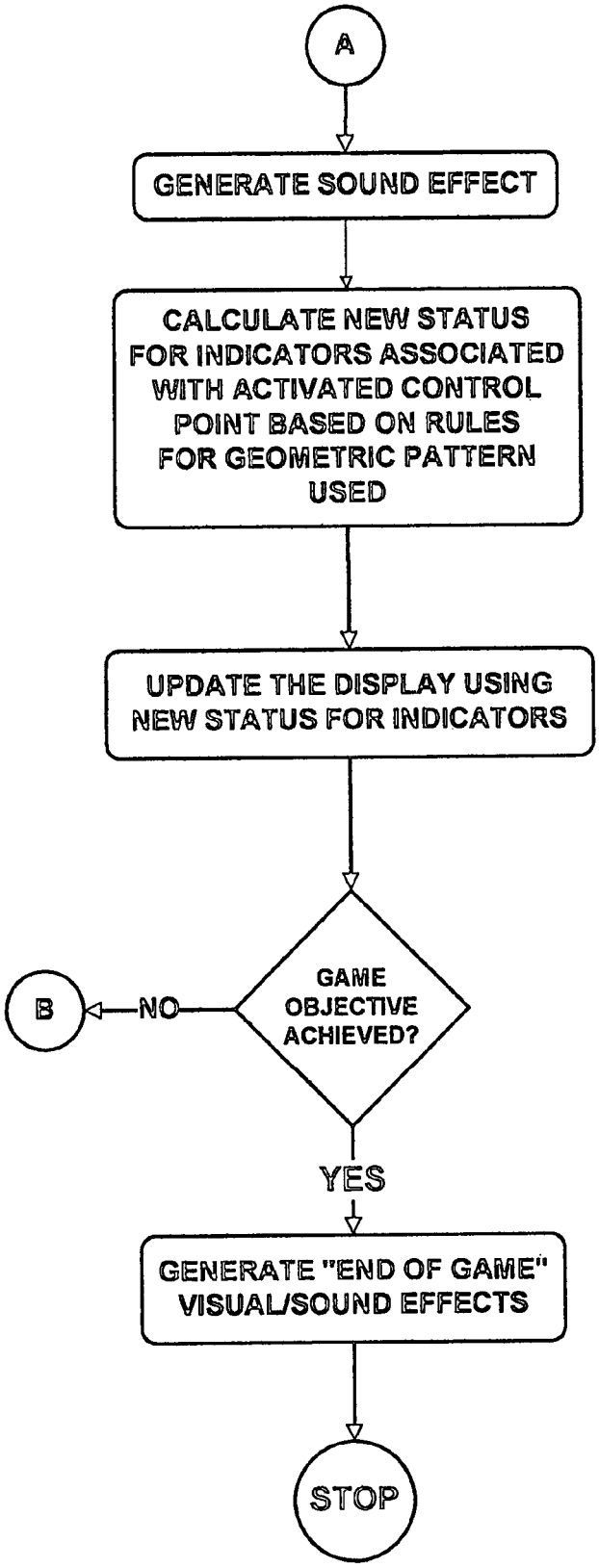

With respect to the operation of any of the devices shown in FIGS. 1, 2, 3, 11 & 13, the logic steps utilized are illustrated in the generic logic flow diagram of FIGS. 18 & 19, which interconnect with each other at the places shown in the various figures. Even though specific reference will not be made to this diagram in the following description of the operation of a device, periodic reference to this diagram may prove to be helpful to the reader hereof. It should be noted that this generic flow diagram includes features that may not be present in all of the devices shown in FIGS. 1, 2, 3, 11 & 13. These features are optional, and it would be a design choice for a game designer to include them in a specific embodiment. This generic logic flow diagram includes the general steps of generating an initial display for a selected game, processing the activation of a control point & updating the display, checking if the objective of a puzzle is met, and rewarding the player by generating audio/visual effects upon the successful completion of a game.

Referring again to FIGS. 16 & 117, in order to operate a device, the player activates the on/off switch, which causes power to be supplied to all terminals of the device from either the battery or some external power source, and which causes the pulse generator to generate a reset pulse. This pulse is applied to the central processing unit and causes it to clear any data remaining in the RAM and in the audio, and LED or LCD drivers over the common data bus. The pulse also causes the central processing unit to initiate a game introduction display that includes sound and visual effects. As would be obvious to a person of ordinary skills in the art, design provisions could be made to allow a player to continue playing a previous game when the device is first turned on. Under such implementation, current game data is stored in memory when the device is turned "OFF," and is restored when the device is turned back "ON."

Referring to FIGS. 18 & 19, after the device is energized, the player is requested to select a puzzle, which is defined by an associated predetermined objective. Then the control program selects a game for the puzzle, either based on player's input, or randomly from a plurality of games stored in the memory of the device. A game is defined by an initial assignment of indicating states to playing positions.

Upon selecting a puzzle, and a game, the microprocessor under the direction of the control program activates the indicators at the playing positions using the initial assignment of indicating states for the selected game. The control program then provides an indication to the player that game play is ready. Such indication could be audible and/or visual.

The microprocessor then awaits an input from the player, i.e. an activation of a control point. Upon receiving such input, the control program determines which control point was activated by the player, and the effect of such activation on the display. This determination is made based on the geometric pattern used for the device, and the algorithms that defines the relationships between the control point and the indicators associated with the geometric pattern associated with that control point.

The microprocessor then updates the displays at affected indicators, and makes a determination if the objective of the puzzle is met. If the player is successful in achieving the objective of the puzzle, then the microprocessor, under the direction of the control program, generates visual and/or sound effects to reward the player for his or her success. Alternatively, if the objective of the game is not reached, then the microprocessor will generate an audible signal and will await another input from the player. The foregoing process is repeated until the player succeeds in solving the puzzle.

As would be understood by those skilled in the art, many different programs may be utilized to implement the flow charts disclosed in FIGS. 18 & 19. Obviously these programs will vary from one another in some degree. However, it is well within the skill of a computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiments shown. Obviously certain modifications, variations and improvements will occur to those skilled in the art upon reading the foregoing. It is, therefore, to be understood that all such modifications, variations and improvements have been deleted herein for the sake of conciseness and readability, but are properly within the scope and spirit of the following claims.

What is claimed and desired to be secured by Letters of Patent is:

1. An electronic puzzle device comprising:

a playfield that includes a plurality of playing positions, each of said playing positions includes at least a first indicator and a second indicator, and each of said indicators has a plurality of indicating states, wherein each indicating state corresponds to a visual indication, wherein the indicators at a playing position can be activated to provide a plurality of concurrent visual indications at said playing position, and wherein an objective is to achieve a predefined pattern of visual indications at the playfield, a plurality of switches to enable a player to interact with the electronic puzzle device, and a microprocessor with a computer-readable medium encoded with a computer program logic to control the operation of the electronic puzzle device, wherein the microprocessor is configured to include:

computer program logic that provides a plurality of geometric patterns on the playfield, wherein each geometric pattern includes a plurality of playing positions, and upon the activation of one of the plurality of switches, computer program logic to execute a first algorithm that causes one indicator of at least one playing position in the associated geometric pattern to change state, and to execute at least a second algorithm that causes a different indicator of at least one other playing position in said geometric pattern to change state.

2. An electronic puzzle device as recited in claim 1 further comprising a housing for the electronic puzzle device.

3. An electronic puzzle device as recited in claim 2 wherein each of said indicators is implemented using light-emitting means.

4. An electronic puzzle device as recited in claim 3 wherein the light emitting means use Light Emitting Diodes.

5. An electronic puzzle device as recited in claim 3 wherein the light emitting means provides at least one illuminated visual indication, and one un-illuminated visual indication.

6. An electronic puzzle device as recited in claim 2, wherein said plurality of playing positions is provided by an LCD screen.

7. An electronic puzzle device as recited in claim 6, wherein said LCD screen is monochromic.

8. An electronic puzzle device as recited in claim 6, wherein said LCD screen is colored.

9. An electronic puzzle device as recited in claim 2, wherein said plurality of playing positions are in the form of a two-dimensional array of playing positions.

10. An electronic puzzle device as recited in claim 2, wherein said plurality of playing positions is mapped on at least one of a plurality of surface areas of a three-dimensional housing.

11. An electronic puzzle device as recited in claim 10, wherein the three-dimensional housing is a cube.

12. An electronic puzzle device as recited in claim 10, wherein the three-dimensional housing is a sphere.

13. An electronic puzzle device as recited in claim 1, further comprising means for a player to select games in various levels of difficulty.

14. An electronic puzzle device as recited in claim 1, further comprising means to generate audio and visual effects.

15. An electronic puzzle device comprising:

a playfield that includes a plurality of playing positions, each of said playing positions includes at least a first indicator and a second indicator, and each of said indicators has a plurality of indicating states, wherein each indicating state corresponds to a visual indication, wherein the indicators at a playing position can be activated to provide a plurality of concurrent visual indications at said playing position, and wherein an objective is to achieve a predefined pattern of visual indications at the playfield, means for controlling the operation of the electronic puzzle device, input control means for a player to interact with the electronic puzzle device, means for providing a plurality of geometric patterns, wherein a geometric pattern includes a plurality of playing positions, and means for controlling the indicating states of different indicators of at least two different playing positions in a geometric pattern.

16. An electronic puzzle device as recited in claim 15, further comprising a housing.

17. An electronic puzzle device as recited in claim 15, wherein each of said indicators is implemented using light emitting means.

18. An electronic puzzle device as recited in claim 15, wherein said plurality of playing positions is provided by an LCD screen.

19. An electronic puzzle device as recited in claim 15, wherein said plurality of playing positions is in the form of a two-dimensional array of playing positions.

20. An electronic puzzle device as recited in claim 15, wherein said plurality of playing positions is mapped on at least one of a plurality of surface areas of a three-dimensional housing.

21. An electronic puzzle device comprising:

a housing, a playfield that includes a plurality of playing positions, each of said playing positions includes at least a first indicator and a second indicator, and each of said indicators has a plurality of indicating states, wherein each indicating state corresponds to a visual indication, wherein the indicators at a playing position can be activated to provide a plurality of concurrent visual indications at the playing position, and wherein an objective is to achieve a predefined pattern of visual indications at the playfield, a microprocessor with a computer-readable medium encoded with a computer program logic to control the operation of the electronic puzzle device, a plurality of input control mechanisms to enable a player to interact with the electronic puzzle device, and wherein the microprocessor is configured to include:

a first computer program logic segment that provides a plurality of fixed geometric patterns at the playfield, wherein a geometric pattern includes a plurality of playing positions, and a second computer program logic segment that is activated by an input control mechanism, and which implements a plurality of algorithms which causes the first indicator of at least one playing position at one of said plurality of geometric patterns to change state and the second indicator of at least one different playing position in said geometric pattern to change state.

22. An electronic puzzle device as recited in claim 21, wherein said plurality of input control mechanisms includes at least one of a mechanical momentary switch, a mouse control mechanism with a momentary switch, and a touch screen control.

23. An electronic puzzle device as recited in claim 21, wherein said indicators are implemented using light emitting means.

24. An electronic puzzle device as recited in claim 21, wherein said indicators are implemented using at least one of a monochromic and a colored LCD screen.

25. An electronic puzzle device as recited in claim 21 further comprising means for providing games in various levels of difficulty.

26. An electronic puzzle device as recited in claim 21 further comprising means for generating audio and visual effects.

27. An electronic puzzle device comprising:

a housing, a playfield that includes a plurality of playing positions, each of said playing positions includes a switch and at least a first indicator and a second indicator, and each of said indicators has a plurality of indicating states, wherein each indicating state corresponds to a visual indication, wherein said first and second indicators can be activated at the same time to provide a plurality of concurrent visual indications at a playing position, and wherein an objective is to achieve a predefined pattern of visual indications at the playfield, and a microprocessor with a computer-readable medium encoded with a computer program logic to control the operation of the electronic puzzle device, wherein the microprocessor is configured to:

provide a plurality of fixed geometric patterns, each of which includes a plurality of playing positions, and employ a plurality of algorithms, which upon the activation of a switch causes the first indicator of at least one playing position in a geometric pattern to change its indicating state, and the second indicator of at least one different playing position in said geometric pattern to change its indicating state.

28. A method for an electronic puzzle having a playfield that is subdivided into a plurality of playing positions, each of said playing positions includes a switch, and at least a first indicator and a second indicator, and each of said indicators has a plurality of indicating states, wherein each indicating state corresponds to a visual indication, wherein the indicators at a playing position can be activated to provide a plurality of concurrent visual indications at the playing position, and wherein an object is to achieve a predefined pattern of visual indications at the playfield, comprising the steps of:

assigning an initial indicating state to each indicator, defining a geometric pattern for each playing position, executing by a processor a first algorithm, which upon activation of a switch at a playing position causes the first indicator of at least one playing position in the geometric pattern associated with said playing position to change its indicating state, and executing by the processor at least a second algorithm, which upon said activation of the switch causes the second indicator of at least one different playing position in said associated geometric pattern to change its indicating state, wherein said first and second algorithms can provide concurrent visual indications at a playing position.

* * * * *